US010427864B2

(12) United States Patent
Polloni et al.

(10) Patent No.: US 10,427,864 B2
(45) Date of Patent: Oct. 1, 2019

(54) RIGID PACK WITH HINGED LID AND INTERNALLY PROVIDED WITH A COLLAR HAVING AN UPPER WALL

(71) Applicant: G.D SOCIETA' PER AZIONI, Bologna (IT)

(72) Inventors: Roberto Polloni, Modigliana (IT); Giuseppe Marchitto, Lugo (IT); Michele Ferrari, Ozzano Emilia (IT); Alessandro Venturoli, Granarolo Dell'emilia (IT); Luca Federici, Bologna (IT)

(73) Assignee: G.D SOCIETA' PER AZIONI, Bologna (IT)

( * ) Notice: Subject to any disclaimer, the term of this patent is extended or adjusted under 35 U.S.C. 154(b) by 92 days.

(21) Appl. No.: 15/545,741

(22) PCT Filed: Apr. 22, 2015

(86) PCT No.: PCT/IB2015/052948
§ 371 (c)(1),
(2) Date: Jul. 24, 2017

(87) PCT Pub. No.: WO2016/120674
PCT Pub. Date: Aug. 4, 2016

(65) Prior Publication Data

US 2018/0016089 A1 Jan. 18, 2018

(30) Foreign Application Priority Data

Jan. 29, 2015 (IT) ..... BO2015A0030

(51) Int. Cl.
*B65D 85/10* (2006.01)

(52) U.S. Cl.
CPC ..... *B65D 85/1045* (2013.01); *B65D 85/1081* (2013.01)

(58) Field of Classification Search
CPC ..... B65D 85/1045; B65D 85/1081
(Continued)

(56) References Cited

U.S. PATENT DOCUMENTS 4,300,676 A * 11/1981 Focke ..... B65D 85/1045 206/264
4,850,482 A * 7/1989 Campbell ..... B65D 85/1045 206/273

(Continued)

FOREIGN PATENT DOCUMENTS

DE 69719795 T2 10/2003
EP 0443365 A2 8/1991

(Continued)

OTHER PUBLICATIONS

International Search Report and Written Opinion, International Application No. PCT/IB2015/052948, dated Aug. 27, 2015.

*Primary Examiner* — Luan K Bui
(74) *Attorney, Agent, or Firm* — Marshall, Gerstein & Borun LLP

(57) ABSTRACT

Rigid pack for tobacco articles comprising: a container, which has a parallelepiped shape and has an open upper end; a lid which is hinged to the container and has a parallelepiped shape; an inner wrap which encloses a group of tobacco articles, and is housed on the inside of the container; and a collar, which embraces the inner wrap, is internally glued to the container, protrudes from the open upper end of the container, and has a front wall which is superimposed and glued to a front wall of the container, and two lateral walls which are superimposed and glued to the lateral walls of the container; the collar has an upper wall, a rear wall, and a pull-out opening for the tobacco articles that is defined by a through-incision and involves a portion of the front wall and a portion of the upper wall.

24 Claims, 28 Drawing Sheets

(58) Field of Classification Search
USPC ..... 206/250, 265, 268, 271, 273; 229/87.13, 229/160.1
See application file for complete search history.

(56) References Cited

U.S. PATENT DOCUMENTS

| | | | | | |
|---|---|---|---|---|---|
| 5,150,720 | A | | 9/1992 | Focke et al. | |
| 5,158,664 | A | * | 10/1992 | Colgan | B65D 85/1045 206/242 |
| 5,480,025 | A | * | 1/1996 | Draucker | B65D 85/1045 206/246 |
| 6,164,444 | A | | 12/2000 | Bray et al. | |
| 7,455,177 | B2 | * | 11/2008 | Serafini | B65D 5/4204 206/265 |
| 8,474,612 | B2 | * | 7/2013 | Bertuzzi | B65D 75/5838 206/264 |
| 9,089,165 | B2 | * | 7/2015 | Bertuzzi | B65D 75/5894 |
| 9,499,331 | B2 | * | 11/2016 | Seyfferth De Oliveira | B65D 85/1045 |
| 2010/0252462 | A1 | * | 10/2010 | Marchetti | B65D 5/606 206/268 |
| 2014/0374290 | A1 | * | 12/2014 | Seyfferth De Oliveira | B65D 85/1045 206/268 |

FOREIGN PATENT DOCUMENTS

| | | | |
|---|---|---|---|
| EP | 0801011 | A1 | 10/1997 |
| EP | 2311632 | A1 | 4/2011 |
| EP | 2471725 | A1 | 7/2012 |
| EP | 2666736 | A1 | 11/2013 |
| WO | WO-2014/147421 | A1 | 9/2014 |

* cited by examiner

RIGID PACK WITH HINGED LID AND INTERNALLY PROVIDED WITH A COLLAR HAVING AN UPPER WALL

CROSS-REFERENCE TO RELATED APPLICATIONS

This is the U.S. national phase of International Application No. PCT/IB2015/052948, filed Apr. 22, 2015, which claims the benefit of Italian Patent Application No. BO2015A000030, filed Jan. 29, 2015.

TECHNICAL FIELD

The present invention relates to a rigid pack with hinged lid and internally provided with a collar.

The present invention finds advantageous application to a pack of cigarettes containing a group of cigarettes of reduced dimension, to which the following description will make explicit reference without thereby losing generality PRIOR ART

BACKGROUND ART

The patent applications EP0443365A2, EP0801011A1 and EP2666736A1 describe a rigid pack of cigarettes with a hinged lid that has been modified to accommodate a group of cigarettes of reduced size, i.e. a group of cigarettes smaller than the total internal volume. The pack of cigarettes comprises a collar, which is provided with containment elements that protrude inward to rest against the group of cigarettes in order to prevent the group of cigarettes from "shaking" inside the pack of cigarettes; in fact, if the group of cigarettes were free to "shake" inside the pack of cigarettes, the movements of the group of cigarettes during handling of the pack of cigarettes (either in the production step, and during the distribution and sales step) would subject the cigarettes to mechanical stress that could easily determine an emptying of the tips (i.e. loss of tobacco fibers from the free ends of the cigarettes). However, this technical solution has some drawbacks, since it is not always able to provide adequate holding of the group of cigarettes (i.e. not always able to prevent effectively the group of cigarettes from "shaking" inside the pack cigarettes).

The patent application EP2311632A1 discloses a cigarette pack having a packing blank made of thin cardboard or similar packing material; the inner fold of the packing blank has protrusions or supporting frames formed by press cut or deformation of the packing material and the protrusions or the supporting frames lie on side surfaces of a cigarette block.

The patent application WO9822367A1 discloses a cigarette pack having a sealed enclosure of barrier material with a resealable access aperture to the enclosure; a cover over that aperture has on all its openable edges a permanently tacky surface overlapping over the barrier material there.

The patent application WO2014147421A1 discloses a pack for tobacco industry products and comprising a lid portion, a body portion, and a collar located at least partially within the body portion and against which at least a portion of the lid abuts when closed.

The patent application WO2012089812A1 discloses a package of consumer goods comprising: a wrapper enclosing the consumer goods and having an access opening through which the consumer goods can be removed, and a cover layer comprising a resealable adhesive label and moveable between a closed position, in which the cover layer covers the access opening and is sealed in place by the adhesive label, and an open position in which the adhesive label is at least partially removed from the wrapper and the access opening is uncovered.

DESCRIPTION OF THE INVENTION

The object of the present invention is to provide a rigid pack of tobacco articles with hinged lid and internally provided with a collar which is free from the drawbacks described above and, in particular, easy and inexpensive to manufacture.

According to the present invention, a rigid pack of tobacco articles with hinged lid and internally provided with a collar as claimed in the appended claims is provided.

BRIEF DESCRIPTION OF DRAWINGS

The present invention will now be described with reference to the accompanying drawings, which illustrate some non-limiting embodiments, wherein.

PREFERRED EMBODIMENTS OF THE INVENTION

Figure 2:
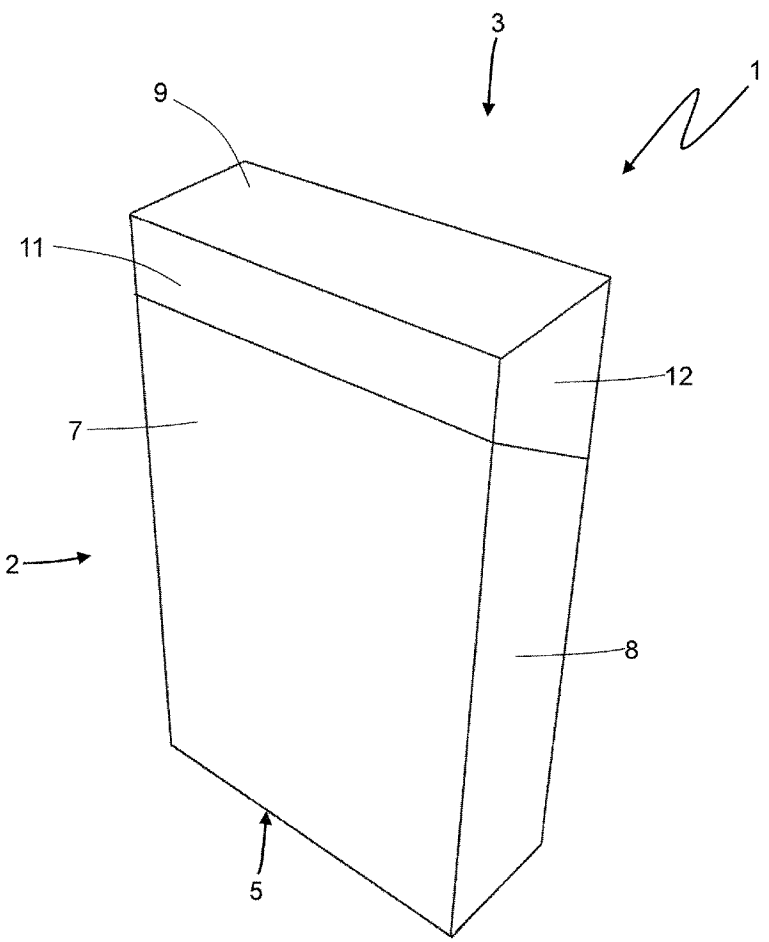
FIG. 2 is a rear perspective view and in a closed configuration of the pack of cigarettes of FIG. 1.
Figure 1:
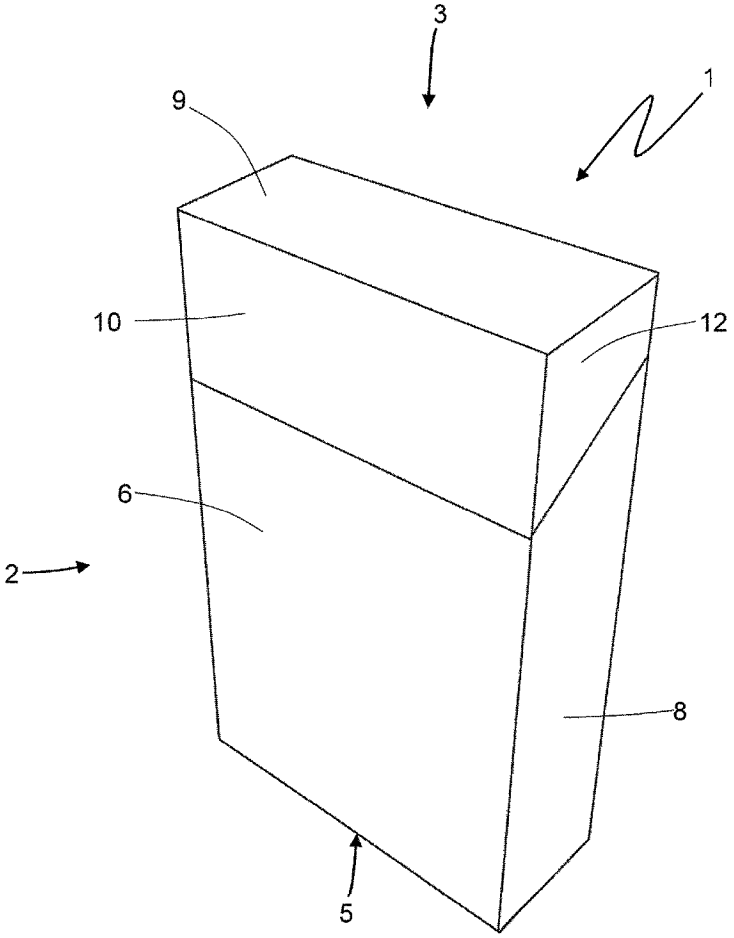
FIG. 1 is a front perspective view and in a closed configuration of a pack of cigarettes according to the present invention.
Figure 3:
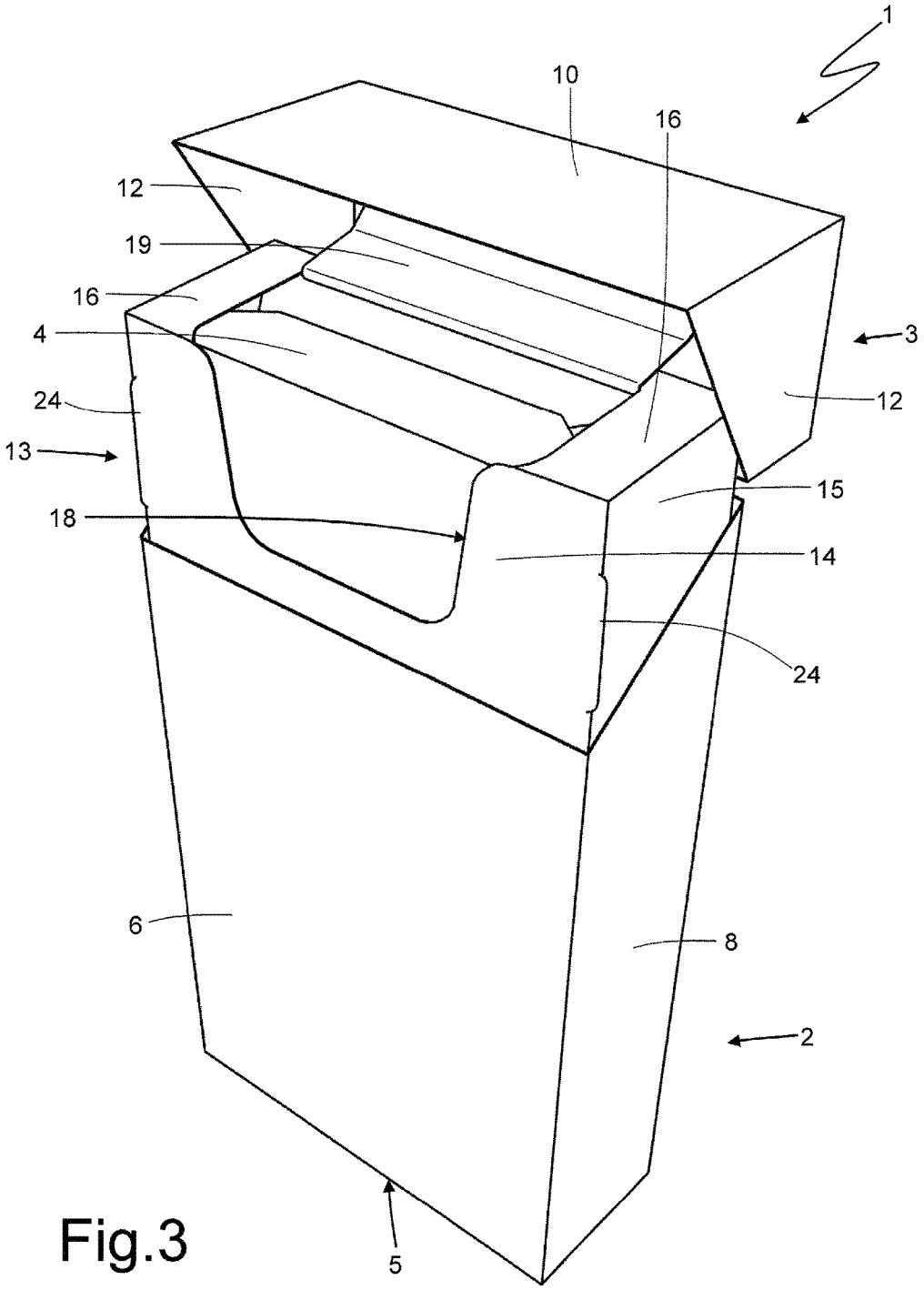
FIG. 3 is a front perspective view and in an open configuration of the pack of cigarettes of FIG. 1.

In FIGS. 1, 2 and 3 number 1 indicates as a whole a rigid pack of cigarettes.

The pack 1 of cigarettes comprises a parallelepiped-shaped container 2, a lid 3 of parallelepiped shape that is hinged at the back to the container 2 to rotate between a closed position (shown in FIGS. 1 and 2) and an open position (illustrated in FIG. 3), and an inner wrap 4 which encloses a group of cigarettes and is housed inside the container 2. Normally (but not obligatorily), the inner wrap 4 is constituted by the group of cigarettes wrapped in a metalized paper sheet of wrapping material which is provided with an upper tear-off portion removable at the first opening of the pack 1 of cigarettes.

The container 2 is cup-shaped, has a parallelepiped shape and has an open upper end, a lower wall 5 opposite the open top end, a front wall 6, a rear wall 7 (parallel and opposite to front wall 6), and two lateral walls 8 (opposite parallel to each other). In the container 2, between the walls 6 and 7 respectively front and rear and the lateral walls 8 four longitudinal edges which are arranged parallel to the cigarettes of the group of cigarettes are defined. In the container 2, between the walls 6, 7 and 8 and the lower wall 5 four transverse edges which are arranged perpendicularly to the cigarettes of the group of cigarettes are defined.

The lid 3 is cup-shaped, has a parallelepiped shape and has a top wall 9 (parallel and opposite to the lower wall 5 of the container 2 when the lid 3 is arranged in the closed position), a front wall 10 (coplanar with the front wall 6 of the container 2 when the lid 3 is arranged in the closed position), a rear wall 11 (hinged to the rear wall 7 of the container 2 and coplanar with the rear wall 7 of the container 2 when the lid 3 is arranged in the closed position), and two lateral walls 12 (coplanar to the corresponding lateral walls 8 of container 2 when the lid 3 is arranged in the closed position). In the lid 3, between the walls 10 and 11 respectively front and rear, and the lateral walls 12 four longitudinal edges which are arranged parallel to the cigarettes of the group of cigarettes are defined. In the lid 3, between the walls 10, 11 and 12 and the upper wall 9 four transverse edges which are arranged perpendicularly to the cigarettes of the group of cigarettes are defined.

In the embodiments illustrated in the attached figures all corners are right angles; according to other embodiments not illustrated and perfectly equivalent part of the longitudinal and/or transverse edges may be bevelled or rounded.

Figure 4:
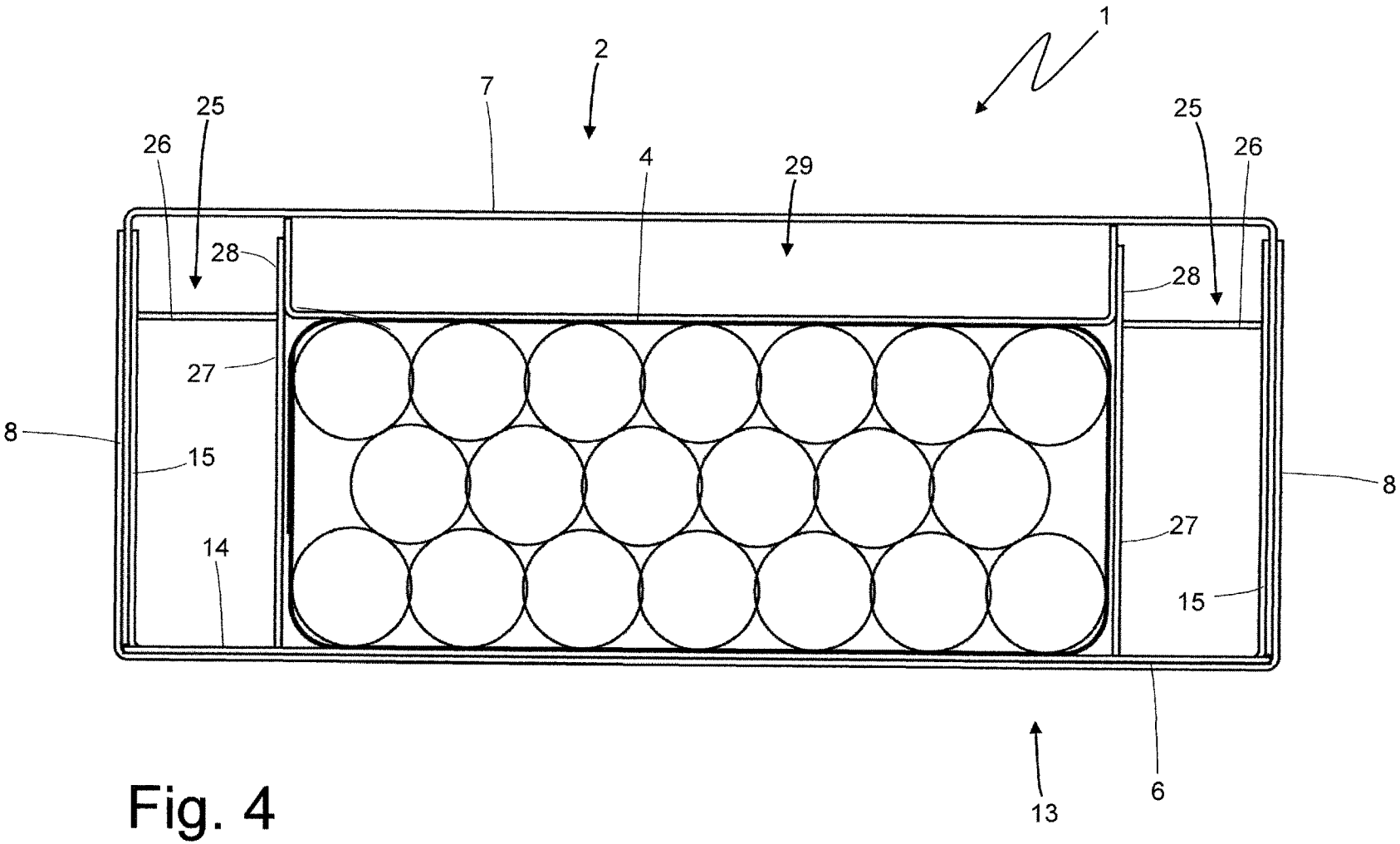
FIG. 4 is a cross-sectional view of the pack of cigarettes of FIG. 1.
Figure 5:
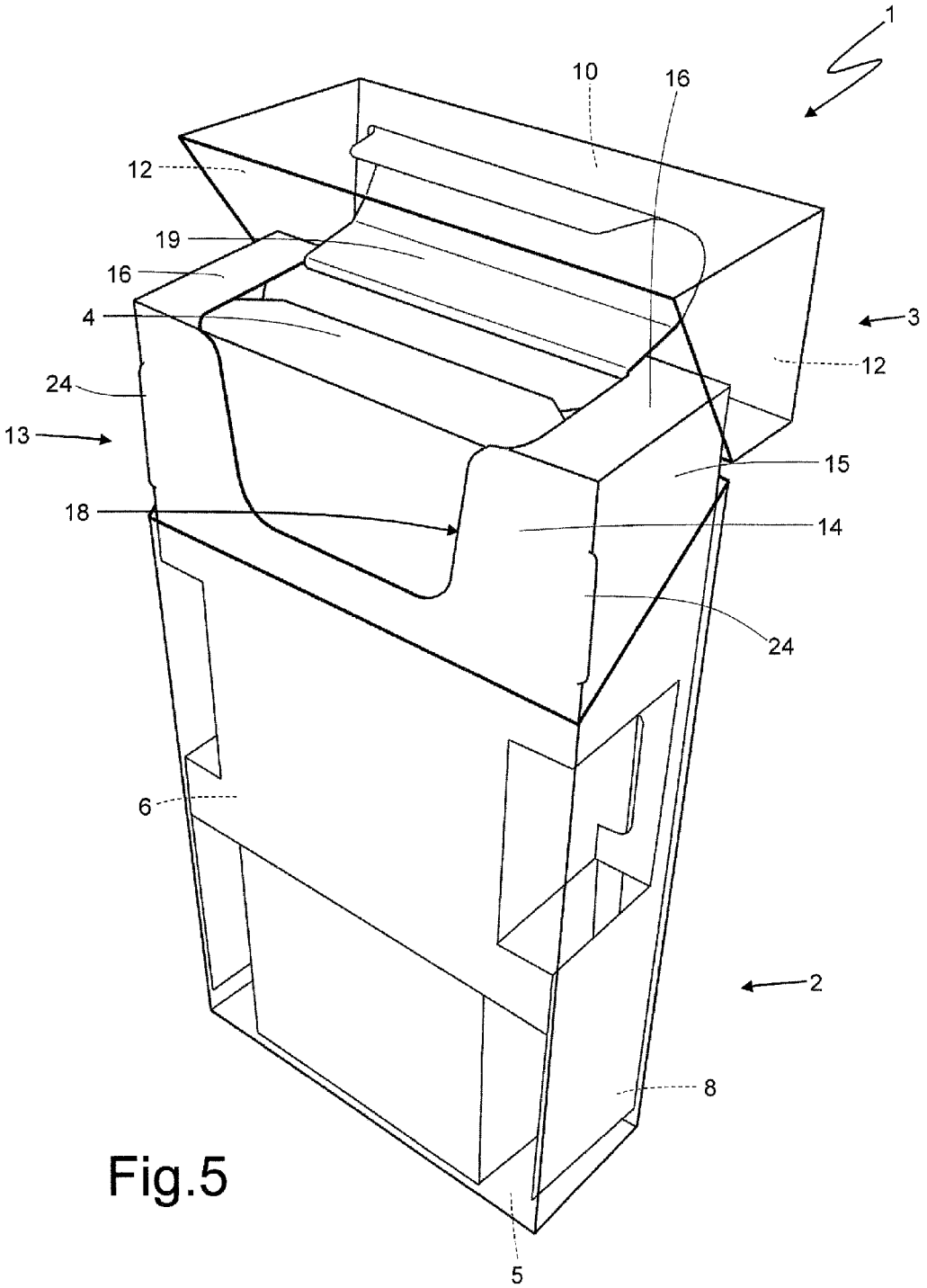
FIG. 5 is a front perspective view and in an open configuration of the pack of cigarettes of FIG. 1 in which the container and the lid are represented in transparency.
Figure 6:
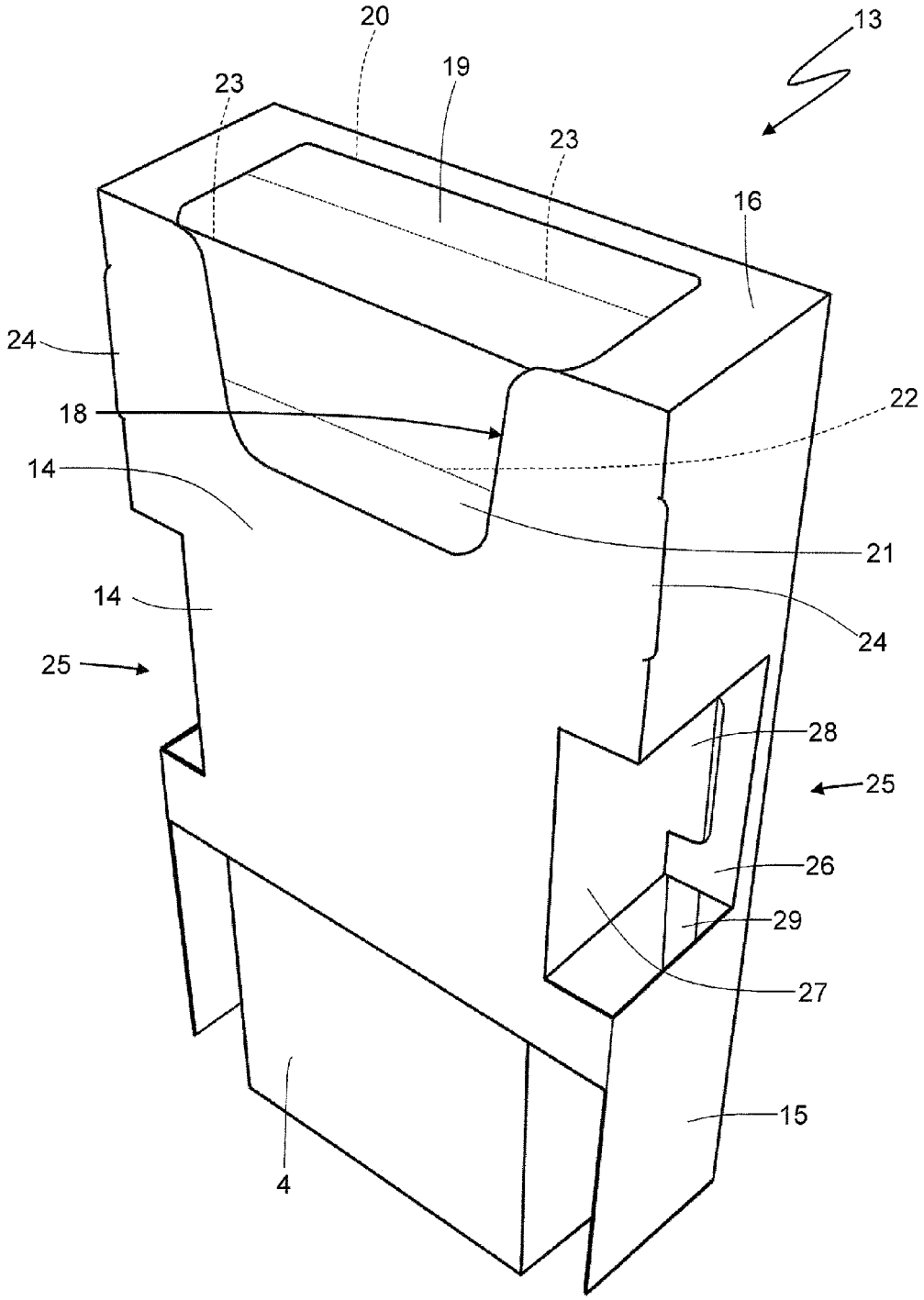
FIG. 6 is a front perspective view and in a closed configuration of a collar of the pack of cigarettes of FIG. 1 coupled to an inner wrap and a filler element.
Figure 7:
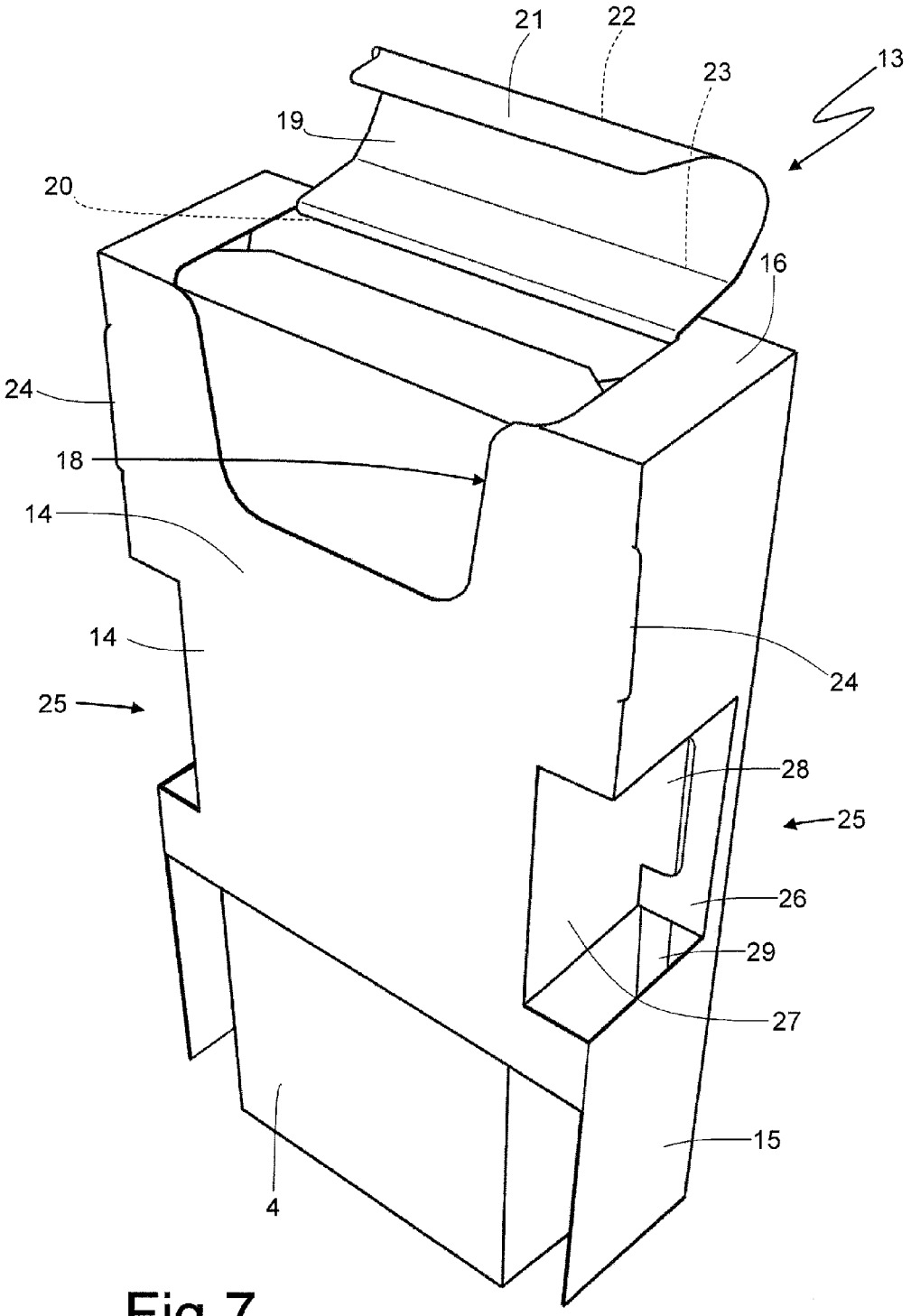
FIG. 7 is a front perspective view and in an open configuration of the collar of FIG. 6 coupled to the inner wrap and to the filler element.
Figure 8:
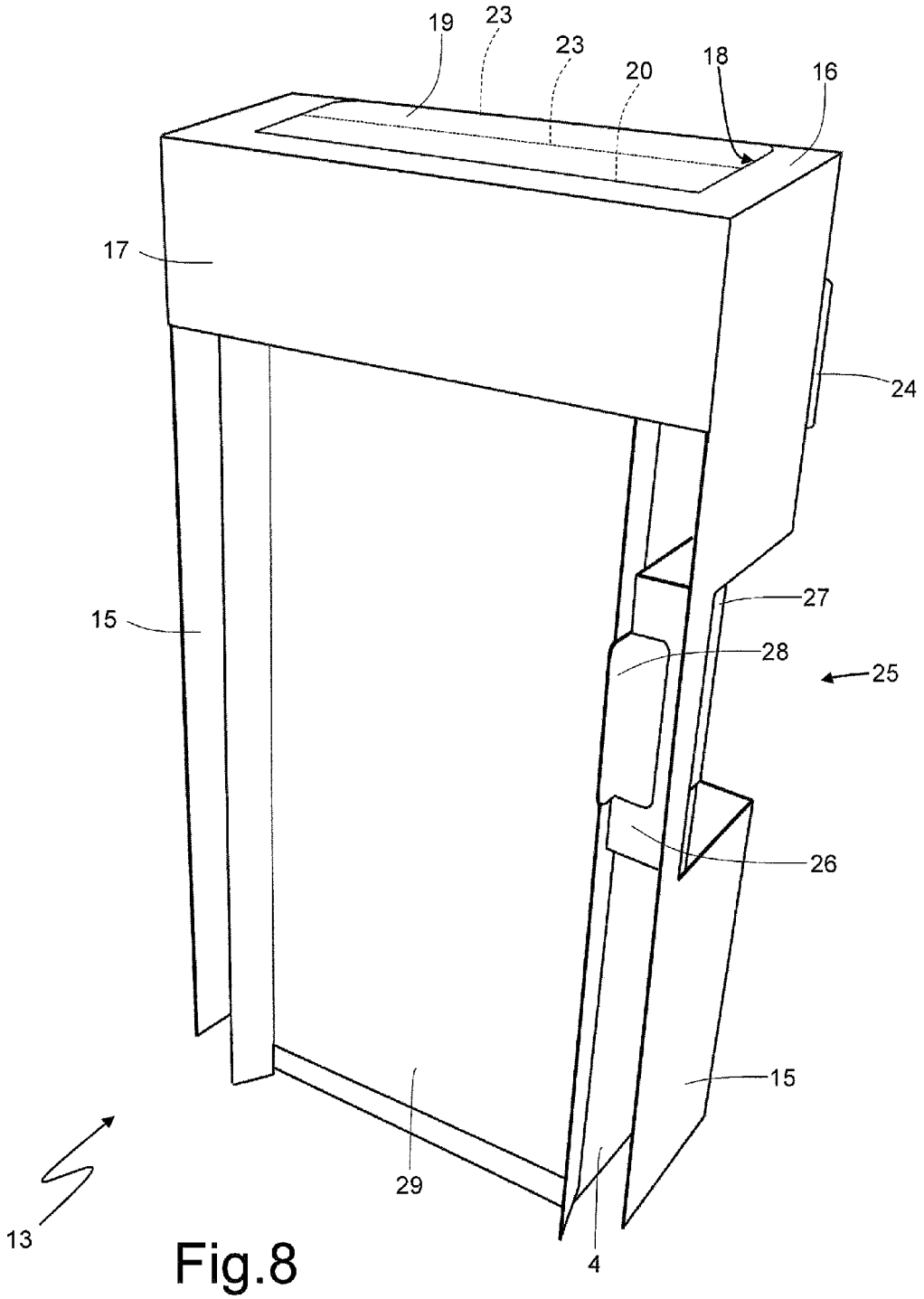
FIG. 8 is a rear perspective view and in a closed configuration of the collar of FIG. 6 coupled to the inner wrap and to the filler element.
Figure 9:
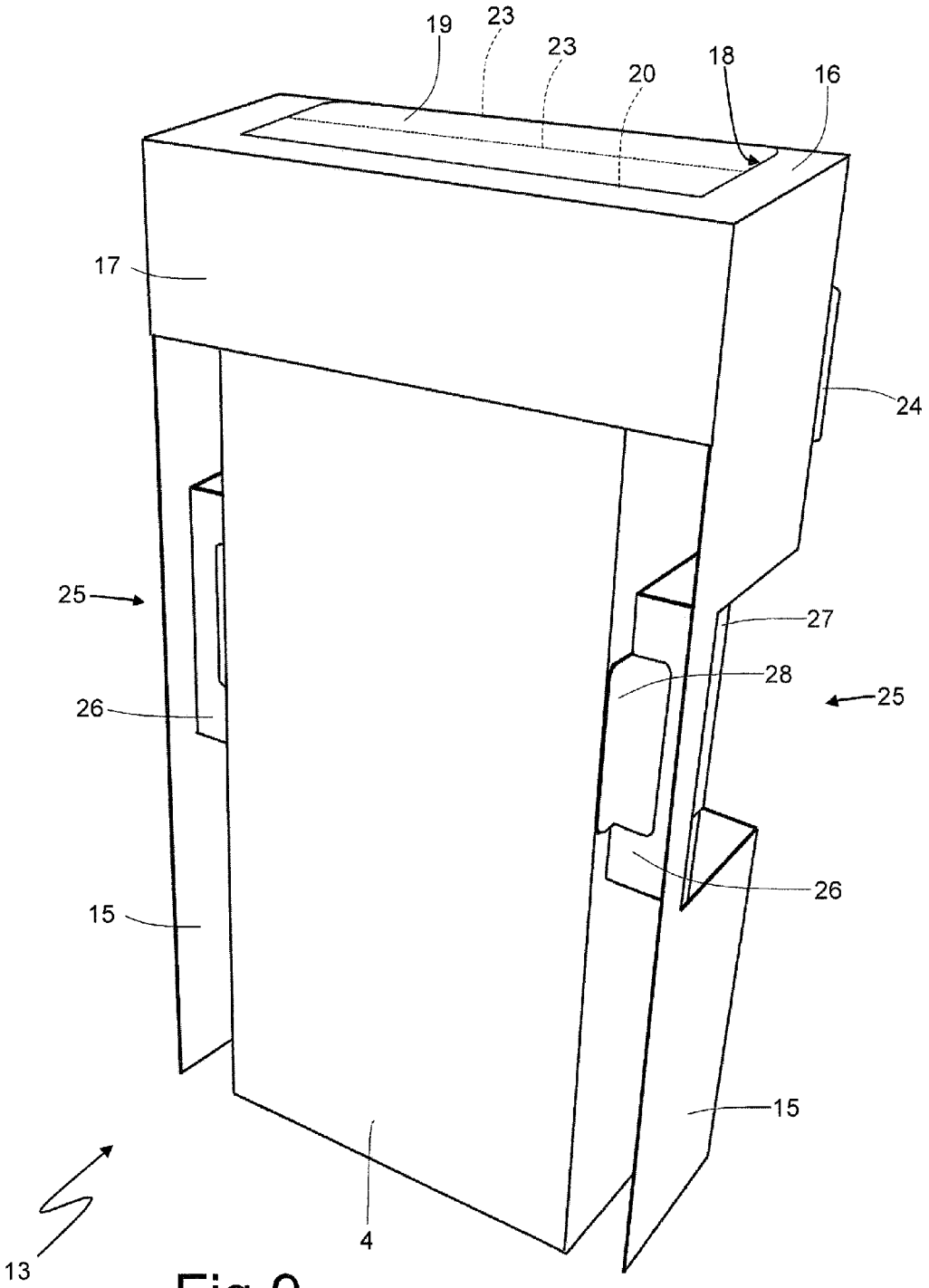
FIG. 9 is a rear perspective view and in a closed configuration of the collar of FIG. 6 coupled to the inner wrap only.
Figure 10:
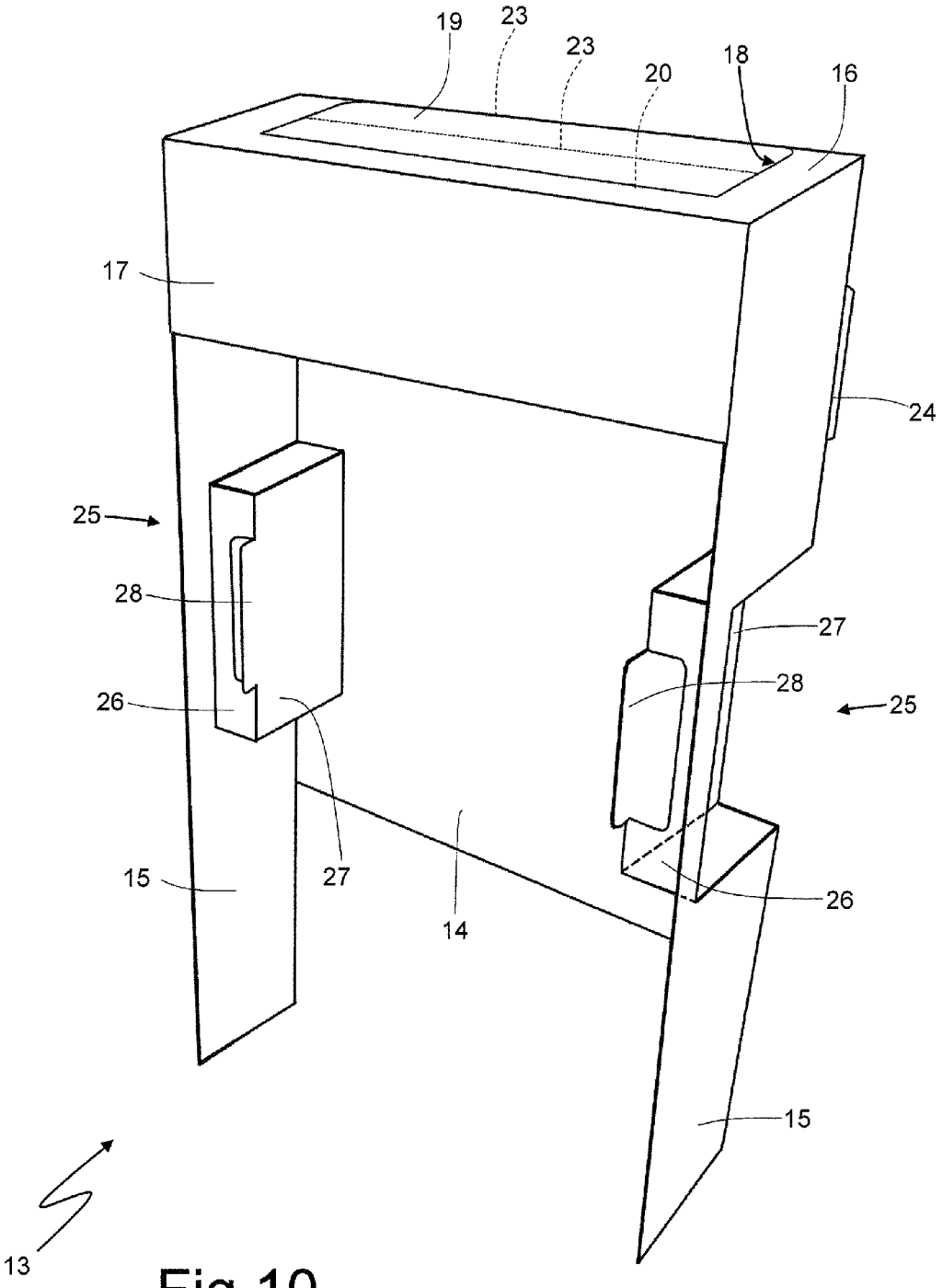
FIG. 10 is a rear perspective view and in a closed configuration of the collar of FIG. 6 only.

As well illustrated in FIG. 4, the inner wrap 4 has a cross section smaller (significantly) than the cross section of the container 2, and then in the container 2 an area of substantial size remains (approximately 10-40% of the total volume of the container 2) not unoccupied by the inner wrap 4. In particular, in the embodiment illustrated in FIG. 4 the inner wrap 4 is narrower than the container 2 (i.e. the width of the inner wrap 4 is less than the inner width of the container 2) and the inner wrap 4 is shallower than the container 2 (i.e. the depth of the inner wrap 4 is less than the depth of the container 2).

As shown in FIGS. 3 and 5-10, the pack 1 of cigarettes comprises a collar 13 which embraces the inner wrap 4, is internally glued to the container 2 and protrudes from the open upper end of the container 2. The collar 13 in cross-section is "U" shaped and has a front wall 14 which is superimposed on and glued to the front wall 6 of the container 2 and two lateral walls 15 which are folded by 90° relative to the front wall 14 and are superimposed on and glued to the lateral walls 8 of the container 2. In addition, the collar 13 comprises an upper wall 16 which is perpendicular to the front wall 14 and is parallel to and facing (and in substantial contact) the upper wall 9 of the lid 3 when the lid 3 is in the closed position (illustrated in FIGS. 1 and 2). Finally, the collar 13 comprises a rear wall 17 which is perpendicular to the upper wall 16, it is parallel and opposite to front wall 6, and is superimposed on and glued to the rear wall 11 of the container 2; furthermore, the rear wall 17 of the collar 13 is parallel to and facing (and in substantial contact) the rear wall 11 of the lid 3 when the lid 3 is in the closed position (illustrated in FIGS. 1 and 2). The front wall 14 of the collar 13 is in direct contact (i.e. rests on) with the front wall 4 of the inner wrap, while the lateral walls 15 of collar 13 are at a certain distance from the lateral walls of the inner wrap 4 and touch the lateral walls the of the inner wrap 4 by means of respective protrusions which will be better described hereinafter.

The collar 13 has a pull-out opening for the cigarettes which is arranged centrally and involves a portion of the front wall 14 of the collar 13 and a portion of the upper wall 16 of the collar 13. The upper wall 16 of the collar 13 comprises a fixed frame which is "U"-shaped and surrounds an upper part of the pull-out opening. The pull-out opening is defined by a through-incision which is made through the collar 13 and internally delimits a mobile portion 19 of the collar 13 that at least initially closes the pull-out opening 18. The front wall 14 of collar 13 comprises a lower part of the mobile portion 19 and a fixing frame which is "U"-shaped, surrounds the lower part of the mobile portion 19, and is separated from the lower part of the mobile portion 19 by the through-incision; similarly, the upper wall 16 of the collar 13 comprises an upper part of the mobile portion 19 and a fixing frame which is "U"-shaped, surrounds the upper part of the mobile portion 19, and is separated from the upper part of the mobile portion 19 by the through-incision.

In the embodiment illustrated in the attached figures, the through-incision which defines the pull-out opening 18 has a "U" open shape and then the mobile portion 19 of the collar 13 remains always connected to the remaining part of the collar and is connected to the remaining part of the collar 13 along a hinge line 20 (i.e. a pre-weakened fold line); in this way, the mobile portion 19 of the collar 13 is liftable with respect to the remaining part of the collar 13 rotating around the hinge line 20. In use, the mobile portion 19 of the collar 13 must be lifted to access the underlying inner wrap 4 after opening the lid 3 and then has to come down again before closing the lid 3. In this embodiment, it is possible to connect (glue) permanently the mobile portion 19 of the collar 13 to the lid 3 to obtain "automatic" opening and closing movements of the mobile portion 19 by exploiting the movement of the lid 3; in other words, by connecting (gluing) the mobile portion 19 of the collar 13 to the lid 3, when opening the lid 3 the lifting of the mobile portion 19 simultaneously is also performed and when closing the lid 3 the lowering of the mobile portion 19 is simultaneously also performed. To obtain a correct movement of the mobile portion 19 of the collar 13 (i.e. to prevent jamming) it is necessary to glue a lower element 21 of the mobile portion 19 to the inner face of the front wall 10 of the lid 3; the lower element 21 of the mobile portion 19 is initially arranged at the front wall 14 of the collar 13 and is separated from the remaining part of the mobile portion 19 by a pre-weakened folding line 22 that locally allows a smooth folding of the mobile portion 19 itself. To obtain a correct movement of the mobile portion 19 of the collar 13 (or to prevent jamming) it is preferable the mobile portion 19 to be provided with at least two further pre-weakened folding lines 23 which are arranged at a certain distance from each other and from the pre-weakened folding line 22; a pre-weakened folding line 23 is initially arranged astride between the front wall 14 and the upper wall 16 of the collar 13, while the other pre-weakened folding line 23 is initially arranged approximately half way of the upper wall 16 the collar 13.

According to a further embodiment not shown, the through-incision which defines the pull-out opening 18 has a "U" closed shape, and therefore the mobile portion 19 of the collar 13 is removed from the collar 13, thus leaving the pull-out opening 18 always open. The elimination of the mobile portion 19 of the collar 13 can take place at the first opening of the pack 1 of cigarettes (in this case the mobile portion 19 is torn and removed by the user), or the deletion of the mobile portion 19 of the collar 13 can take place during the manufacturing of pack 1 of cigarettes. When deletion of the mobile portion 19 of the collar 13 occurs at the first opening of the pack 1 of cigarettes, the mobile portion 19 may be glued to the underlying upper portion of the inner wrap 4 removable by tearing so as to eliminate the mobile portion 19 of the collar 13 and the removable tear-off upper portion of the inner wrap 4 together with a single gesture.

Preferably, the through-incision which defines the pull-out opening 18 is not initially completely continuous, i.e. initially having residual contact points which can be easily torn; in this way, the collar 13 is more easily handled during manufacturing of the pack 1 of cigarettes as the mobile portion 19 of the collar 13 remains integral with the remaining part of the collar 13 without the possibility to make unwanted and completely random movements.

The collar 13 has the function of keeping in a correct position the inner wrap 4, or to prevent the inner wrap 4 from performing unwanted movement inside the container 2 (being the inner wrap 4 smaller than the container 2). Furthermore, the collar 13 also has the function of keeping the lid 3 in the closed position with a certain force to prevent unwanted openings of the lid 3 itself; this function of "locking" the lid 3 in the closed position is carried out thanks to the fact that when the lid 3 is in the closed position the collar 13 partially protrudes from the open end of the inner container 2 and then engages a corresponding inner surface of the lid 3: in this way to open the lid 3 it is required to elastically and slightly deform the lid 3 and/or the collar 13 and therefore it is necessary to apply a certain force to the lid to open the lid 3 itself. According to a preferred embodiment illustrated in the attached figures, the front wall 14 of the inner container 3 is provided with a pair of claws 24 which project laterally to engage by interference with the lid 3 when the lid 3 is in the closed position so as to keep with greater force the lid 3 in the closed position. According to a different embodiment not illustrated, the front wall 14 of inner container 3 is devoid of claws 24.

To keep the inner wrap 4 in a correct position compensating for the smaller width of the inner wrap 4 with respect to the width of the container 2, the collar 13 comprises a pair of support elements 25, each of which projects (protrudes) from a corresponding lateral wall 15 of collar 13 and rests against the inner wrap 4 to help keep the correct position inside the inner wrap 4 itself. I.e. the two support elements 25 have protrusions that protrude inwardly from the lateral walls 15 of collar 13 and touch the lateral walls of the inner wrap 4. Each support element 25 in cross-section is "L"-shaped and comprises a panel 26 that originates from a corresponding lateral wall 15 of collar 13 and is perpendicular to the wall 15 itself and a lateral panel 27 which is joined to the panel 26, originates from the front wall 14 of the collar 13, is perpendicular to the front wall 14 and rests on a corresponding lateral wall of the inner wrap 4. According to a preferred (but not binding) embodiment, each panel 27 has an appendage 28 that comes out from the panel 27 itself projecting from the plane defined by the corresponding panel 26; the appendage 28 is obtained by means of a through-incision, which is "U"-shaped and is made through the corresponding panel 26.

Figure 17:
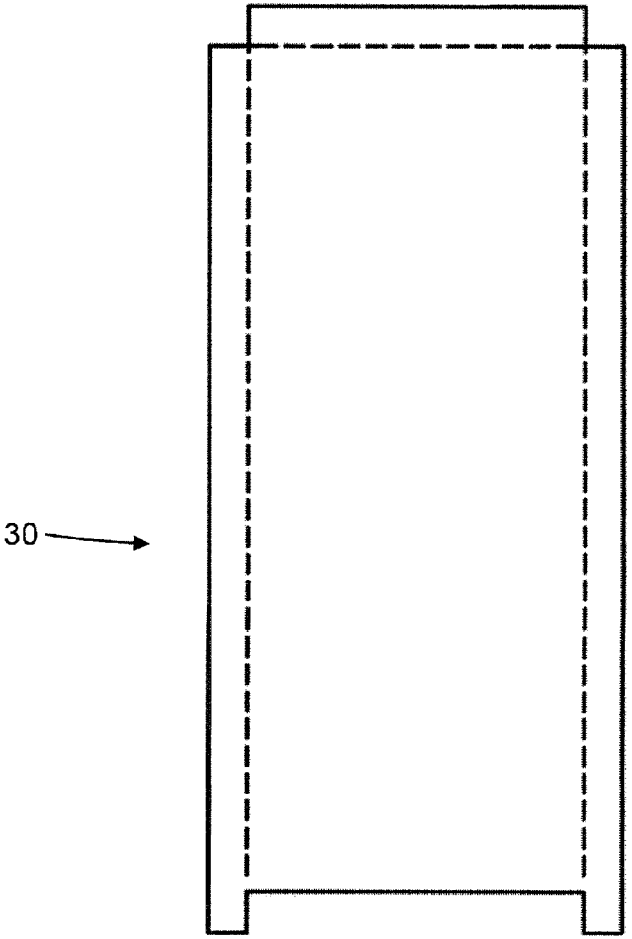
FIG. 17 is a plan view of a blank used to make the filler element of FIG. 16.
Figure 16:
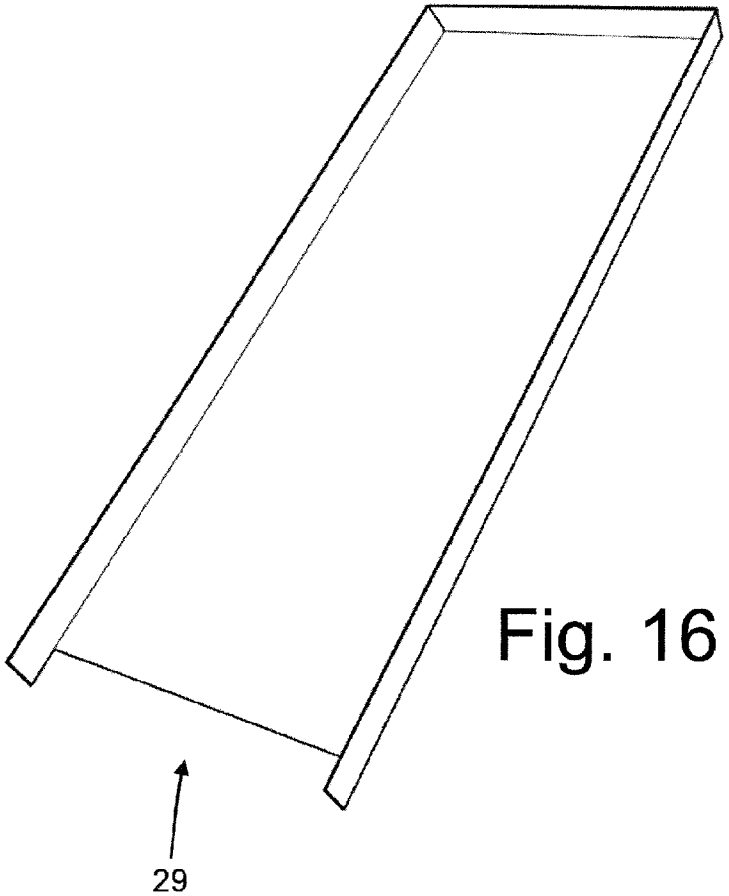
FIG. 16 is a perspective view of a filler element of the pack of cigarettes in FIG. 1.

To keep the inner wrap 4 in a correct position by compensating the smaller thickness of the inner wrap 4 than the thickness of the container 2, to the inner wrap 4 is coupled a filler element 29, which is interposed between a rear wall of the inner wrap 4 and the rear wall 7 of the container 2. According to a preferred (but not binding) embodiment, the filler element 29 has the same width of the inner wrap 4 and is arranged between the two appendages 28 of the panels 27 so as to be kept centred by the two appendages 28 themselves; alternatively, the appendages 28 of the panels 27 are absent and the filler element 29 has the same width of the container 2 (i.e. larger than the inner wrap 4). In the embodiment illustrated in the attached figures, the filler element 29 is box-shaped (as best illustrated in FIG. 16), i.e. consists of an internally hollow body formed by folding a blank 30 of cardboard (shown in FIG. 17); alternatively, the filler element 29 is made from corrugated cardboard (the corrugation of the cardboard does increase the overall thickness of the cardboard without a corresponding significant increase of weight).

Figure 11:
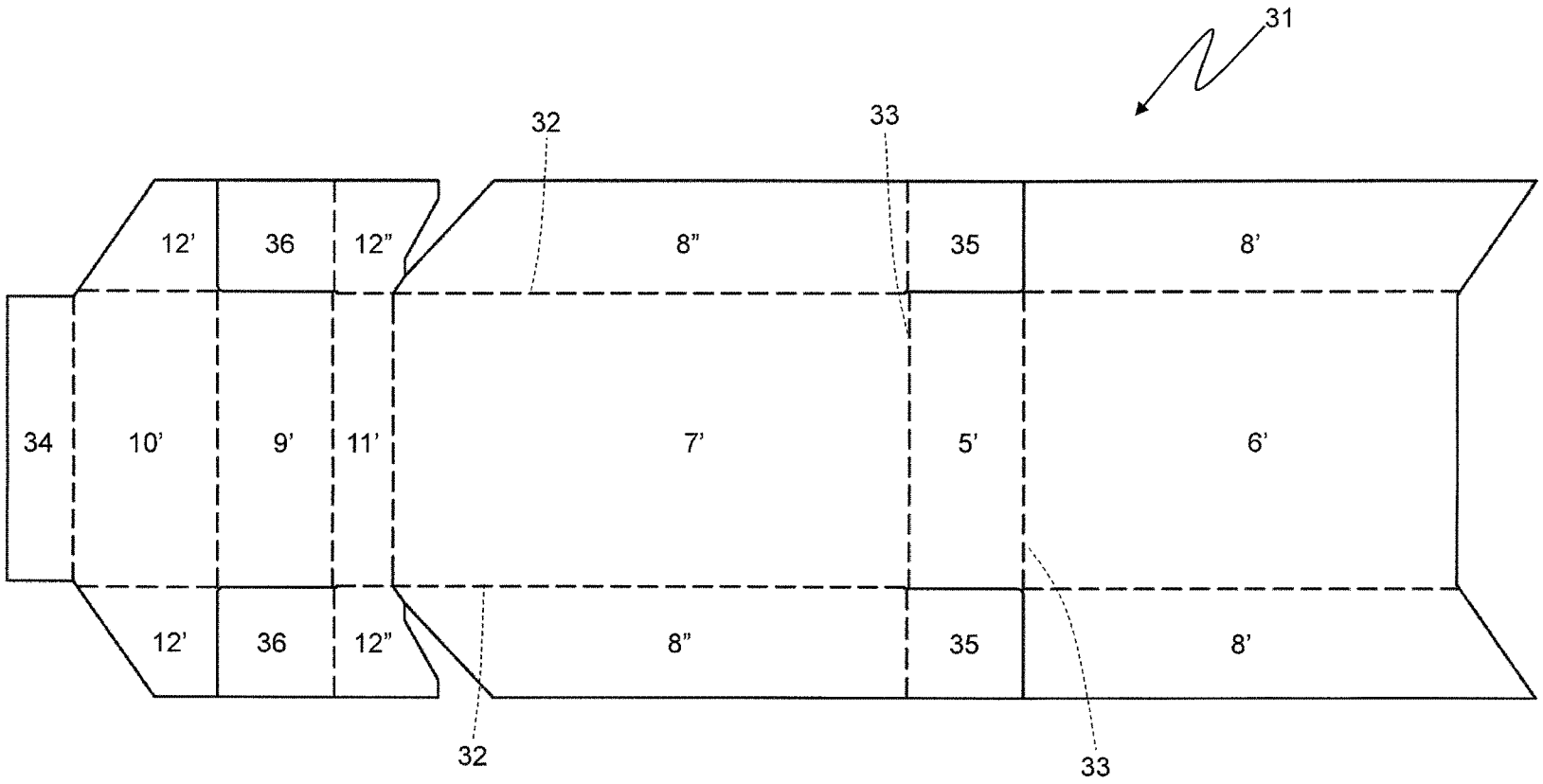
FIG. 11 is a plan view of a blank used to provide a container and a lid for the pack of cigarettes in FIG. 1.

The container 2 and the lid 3 are obtained by folding a blank (shown in FIG. 11) around the inner wrap 4 and the collar (previously folded around the inner wrap 4) the blank 31 comprising a plurality of panels that are tagged with accented reference numbers equal to the reference numbers that distinguish the corresponding walls of the container 2 and the lid 3 As shown in FIG. 11, the blank 31 has two longitudinal folding lines 32 (which define the longitudinal edges of the container 2 and of the lid 3) and a plurality of transverse folding lines 33 defining, between the two longitudinal folding lines 32, a panel 6' forming the front wall 6 of the container 2, a panel 5' forming the lower wall 5 of the container 2 and is directly connected to the panel 6' along a transverse folding line 33, a panel 7' that constitutes the rear wall 7 of the container 2 and is directly connected to the panel 5' along a transverse folding line 33, a panel 11' that constitutes the rear wall 11 of the lid 3 and is directly connected to panel 7' along a transverse folding line 33, a panel 9' that constitutes the upper wall 9 of the lid 3 and is directly connected to panel 11' along a transverse folding line 33, a panel 10' which constitutes the front wall 10 of the lid 3 and is directly connected to the panel 9' along a transverse folding line 33.

The blank 31 comprises a tab 34, which is connected to panel 10' along a transverse folding line 33, is folded by 180° onto the panel 10', and is internally glued to the panel 10' itself.

The blank 31 comprises a pair of wings 8', which are arranged on opposite sides of the panel 6', are connected to the panel 6' along the two longitudinal folding lines 32, and form part of the lateral walls 8 of container 2. The blank 31 comprises a pair of wings 8", which are arranged on opposite sides of panel 7', are connected to the panel 7' along the two longitudinal folding lines 32, constitute part of the lateral walls 8 of container 2, and are glued and superimposed on the corresponding wings 8'. Each wing 8" comprises a flap 35 which is folded by 90° with respect to the wing 8" and is superimposed on and glued to the panel 5'.

The blank 31 comprises a pair of wings 12', which are arranged on opposite sides of panel 10', are connected to panel 10' along the two longitudinal folding lines 32, and form part of the lateral walls 12 of the lid 3. The blank 31 comprises a pair of wings 12", which are arranged on opposite sides of panel 11', are connected to panel 11' along the two longitudinal folding lines 32, constitute part of the lateral walls 12 of the lid 3, and are glued and superimposed on the corresponding wings 12'. Each wing 12" comprises a flap 36 which is folded by 90° with respect to the wing 12" and is superimposed on and glued to the panel 9'.

The collar 13 is obtained by folding a blank 37 (shown in FIG. 12) around the inner wrap 4 the blank 37 comprising a plurality of panels that will be marked with accented reference numbers equal to the reference numbers that distinguish the corresponding walls of the collar 13. According to that illustrated in FIG. 12, the blank 31 comprises a panel 14' which constitutes the front wall 14 of the collar 13, a panel 16' which constitutes the upper wall 16 of the collar 13 and is directly connected to the panel 14' along a transverse folding line, and a panel 17' which constitutes the rear wall 17 of the collar 13 and is directly connected to the panel 16' along a transverse folding line. The blank 37 comprises a pair of wings 15', which are arranged on opposite sides of panel 14', are connected to panel 14' along two longitudinal folding lines, and form the lateral walls 15 of collar 13.

Figure 12:
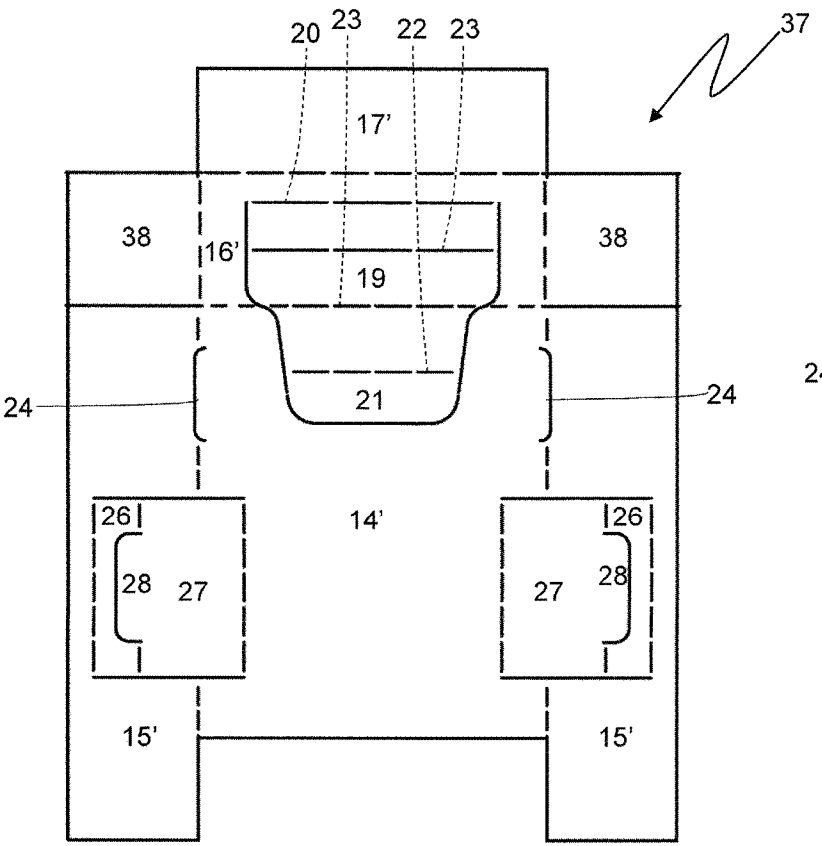
FIG. 12 is a plan view of a blank used to make the collar of FIG. 6.

In the embodiment illustrated in FIG. 12, the panel 16' (i.e. the upper wall 16 of the collar 13) comprises a pair of connecting flaps 38, each of which is folded by 90° with respect to panel 16' (i.e. with respect to the upper wall 16 of the collar 13) and is glued to an inner face of a corresponding flap 15' (i.e. of a corresponding lateral wall of collar 13). In the variant shown in FIG. 13, the connecting flaps 38 are displaced from the panel 16' (i.e. from the upper wall 16 of the collar 13) to the wings 15' (i.e. to the lateral walls 15 of the collar 13), therefore in this embodiment, each wing 15' (i.e. each lateral wall 15 of collar 13) comprises a connecting flap 38, which is folded by 90° with respect to the wing 15' (i.e. to the corresponding lateral wall 15 of collar 13) and is glued to a inner face of the panel 16' (i.e. of the upper wall 16 of the collar 13). The function of the connecting flaps 38 is to establish a mechanical connection between the upper wall 16 of the collar 13 and the lateral walls 15 of collar 13 (which are glued to the lateral walls 8 of container 2) to make the upper wall 16 of the collar 13 more stable, and then, among other things, improve the containment of the inner wrap 4 and make for easier and repeatable the movement of the mobile portion 19 of the collar 13 (both when the mobile portion 19 is opened and closed, and when the mobile portion 19 is torn-off and removed).

Figure 13:
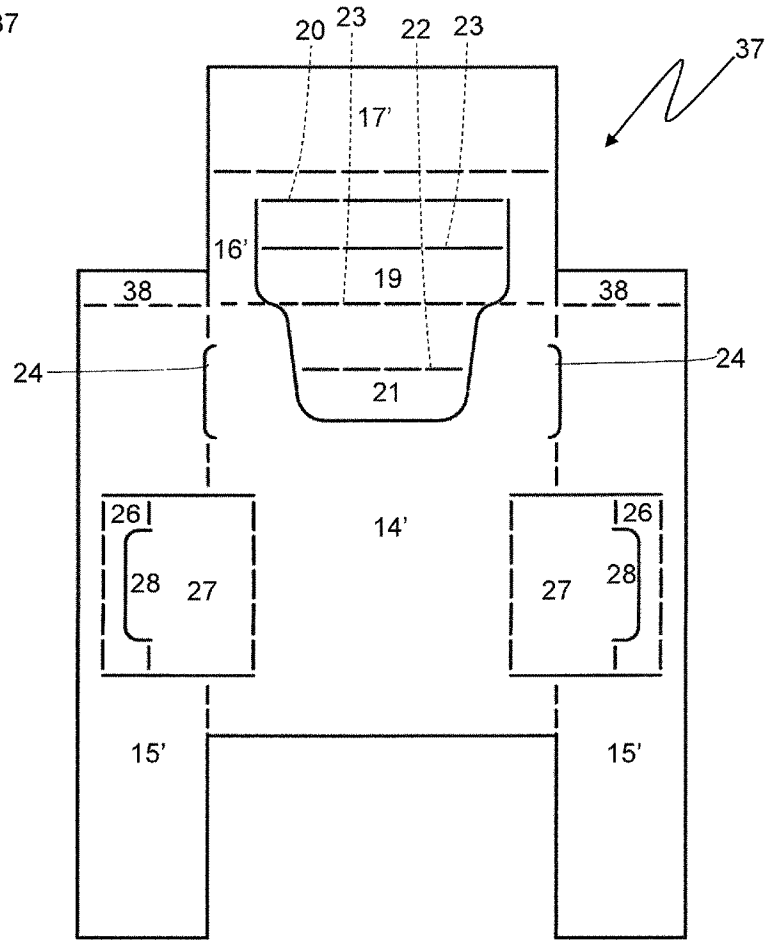
FIGS. 13, 14 and 15 are plan views of three alternatives of the blank of FIG. 12.
Figure 15:
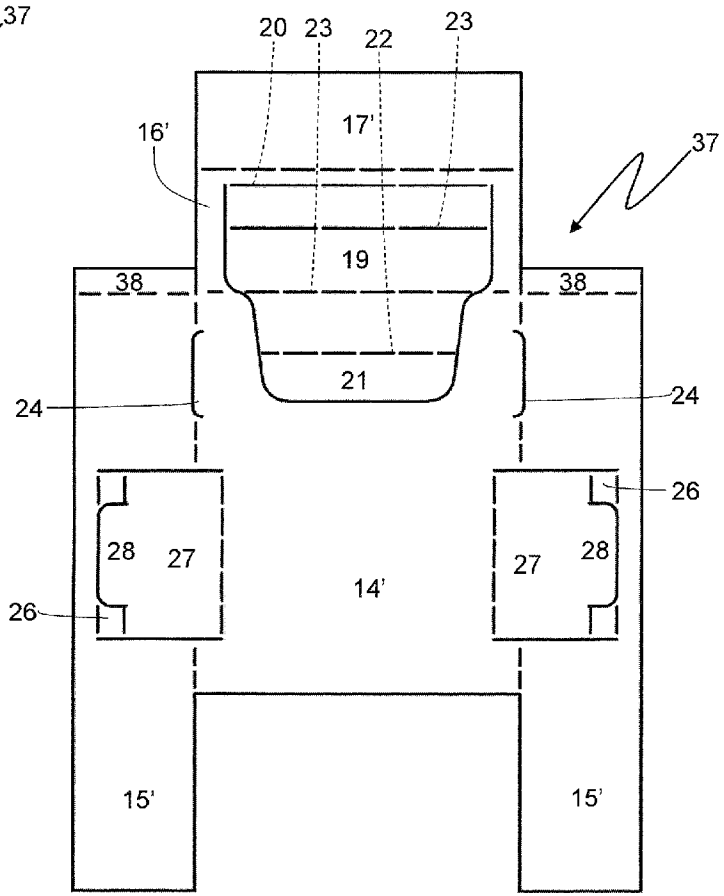
Figure 14:
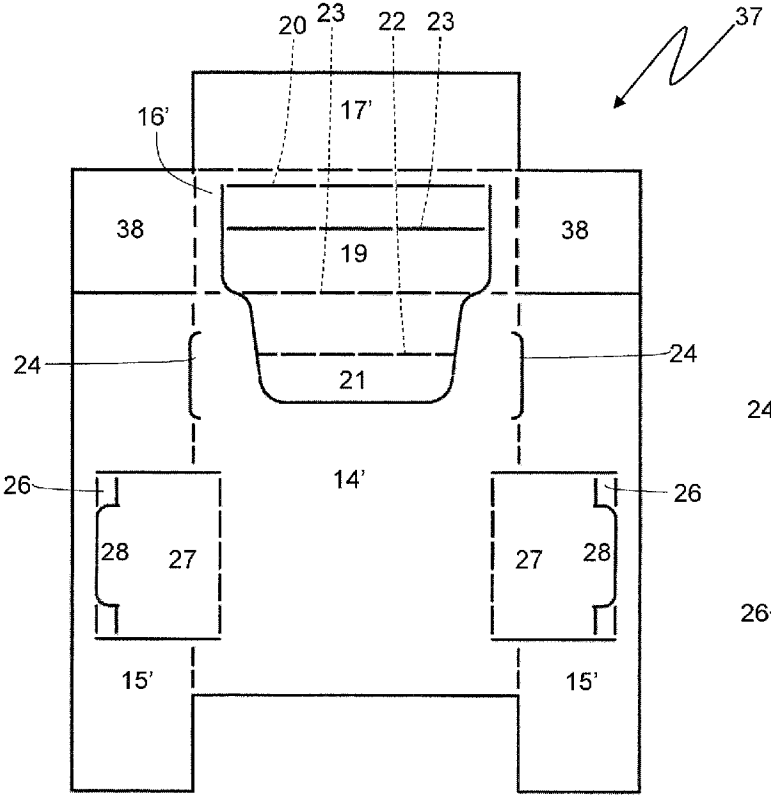

The blanks 37 illustrated in FIGS. 14 and 15 differ from the corresponding blanks 37 illustrated in FIGS. 12 and 13 only for the size of the panels 25 and 26: in particular, in the blanks 37 illustrated in FIGS. 14 and 15 the panels 27 are wider and the panels 26 are narrower.

Figure 18:
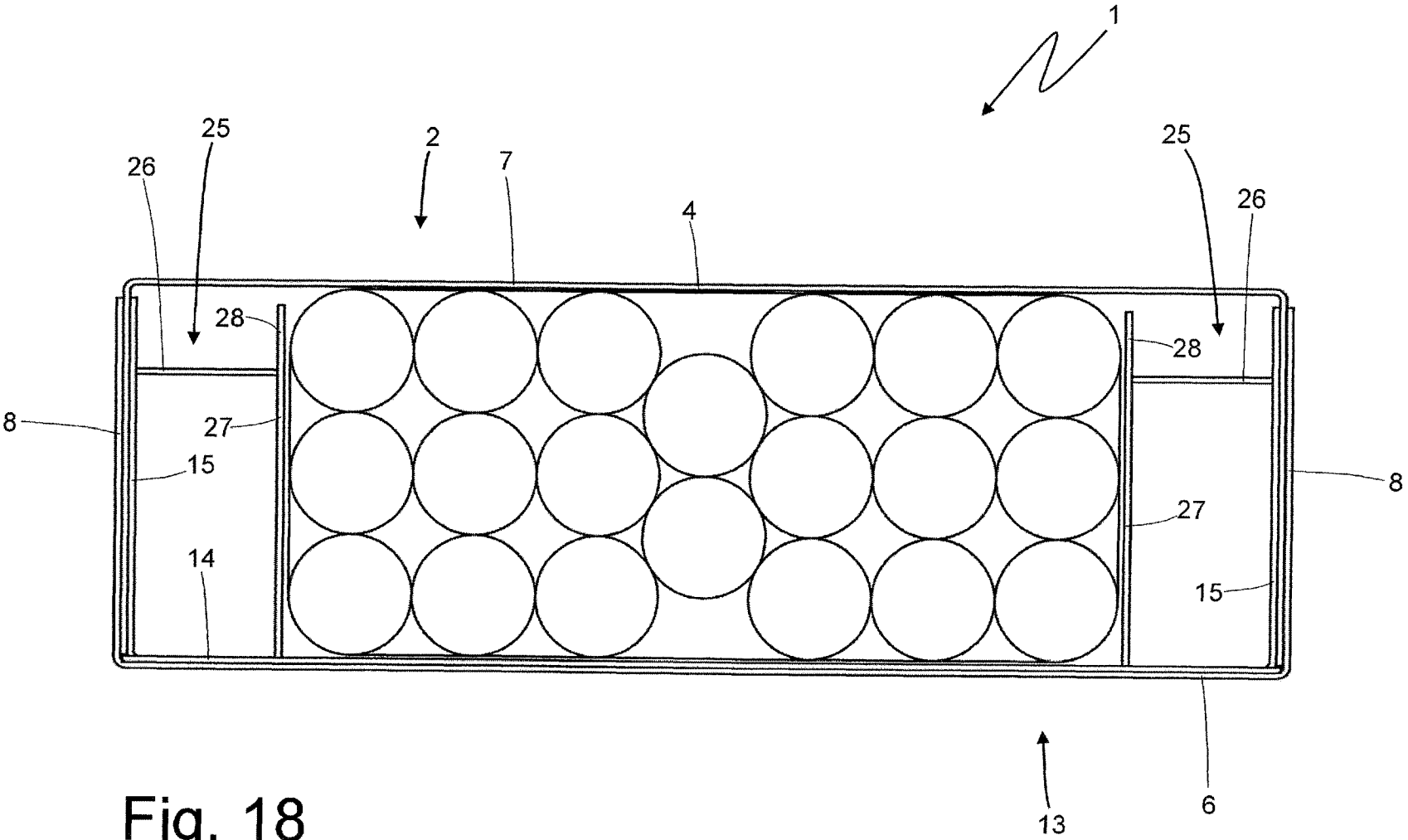
FIG. 18 is a cross-sectional view of a further embodiment of the pack of cigarettes in FIG. 1.
Figure 19:
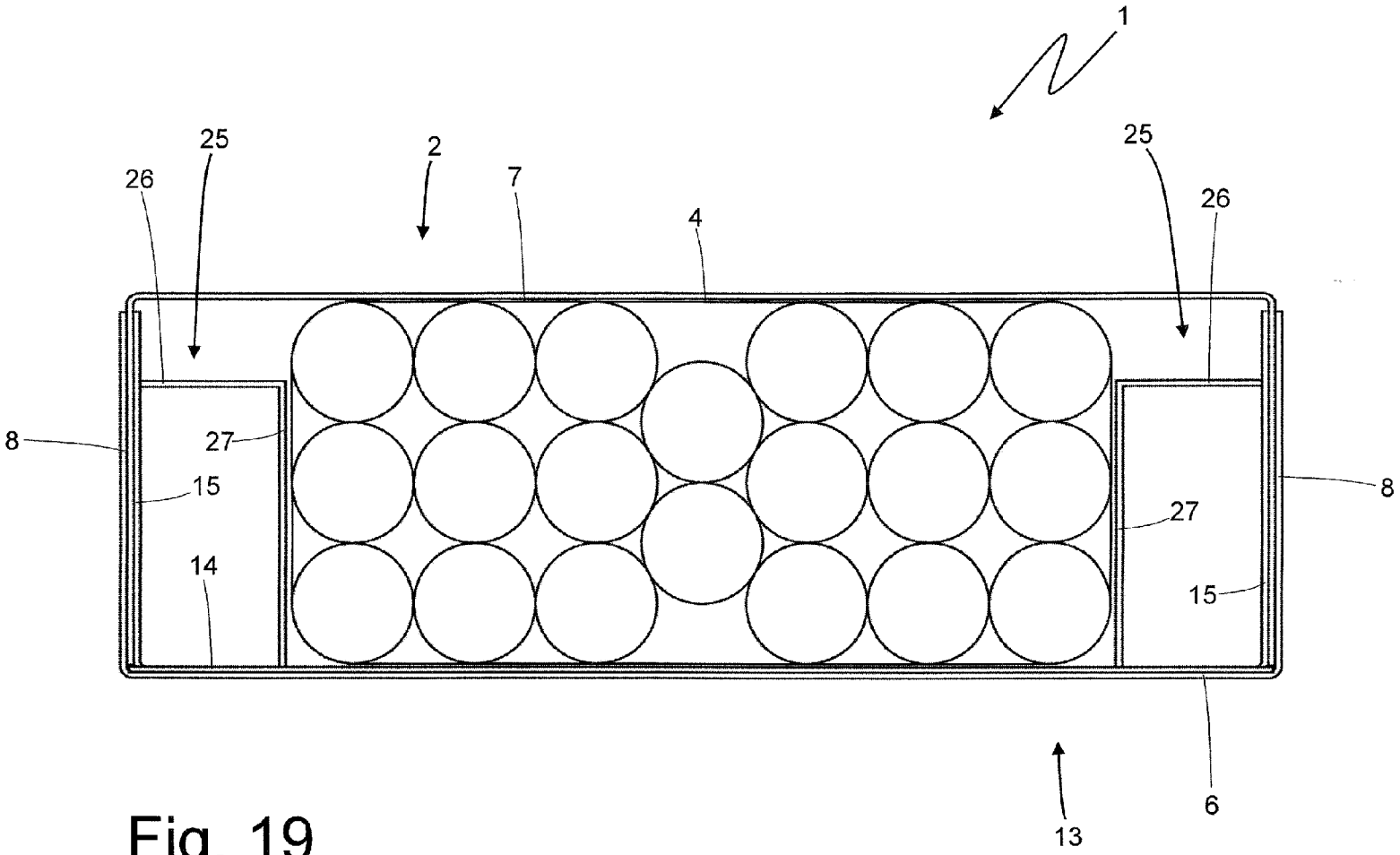
FIG. 19 is a cross-sectional view of an alternative of the pack of cigarettes of FIG. 18.
Figure 21:
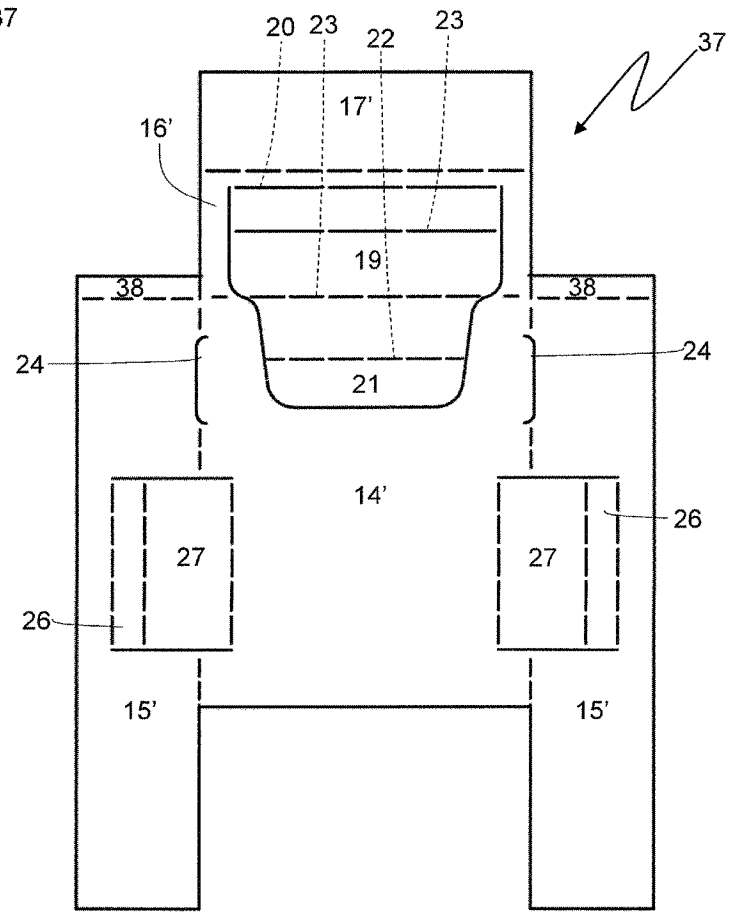
FIG. 21 is a plan view of an alternative of the blank of FIG. 20.
Figure 20:
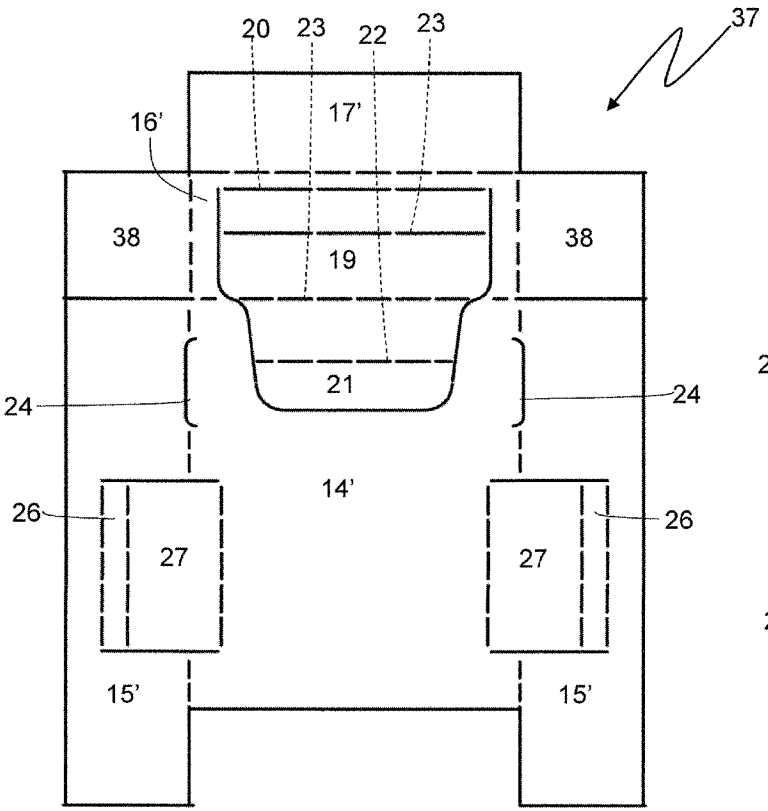
FIG. 20 is a plan view of a blank used to make a collar of the pack of cigarettes of FIG. 19.

In the different embodiment illustrated in FIGS. 18 and 19, the inner wrap 4 has the same depth of the container 2 and therefore is devoid of all filler element 29. In the pack 1 of cigarettes shown in FIG. 18, the support elements 25 of the collar 13 comprise appendages 28 (therefore the collar 13 is obtained by using one of the blanks 37 illustrated in FIGS. 12-15), while in the pack 1 of cigarettes shown in FIG. 19, the support elements 25 of the collar 13 are devoid of the appendages 28 (therefore the collar 13 is obtained by using one of the blanks 37 illustrated in FIGS. 20 and 21). According to another embodiment not illustrated, the inner wrap 4 is less deep than the container 2 (thus having the filler element 29) and the inner wrap 4 has the same inner width of the container 2 (therefore the collar 13 is devoid of support elements 25). According to a further embodiment not illustrated, the inner wrap 4 has the same depth of the container 2 (thus there is no filler element 29) and the inner wrap 4 has the same inner width of the container 2 (therefore the collar 13 is devoid of support elements 25); in this case, it is not necessary to provide any particular internal containment to the inner wrap 4 as the inner wrap 4 has the same internal dimensions of the container 2 and the presence of the upper wall 16 of the collar 13 is justified by the fact of requiring the part 19 of the movable collar 13 which can provide a better closure of the inner wrap 4 after the first opening of the pack 1 of cigarettes (i.e. after the removal of the removable tear-off upper portion of the inner wrap 4).

Figure 22:
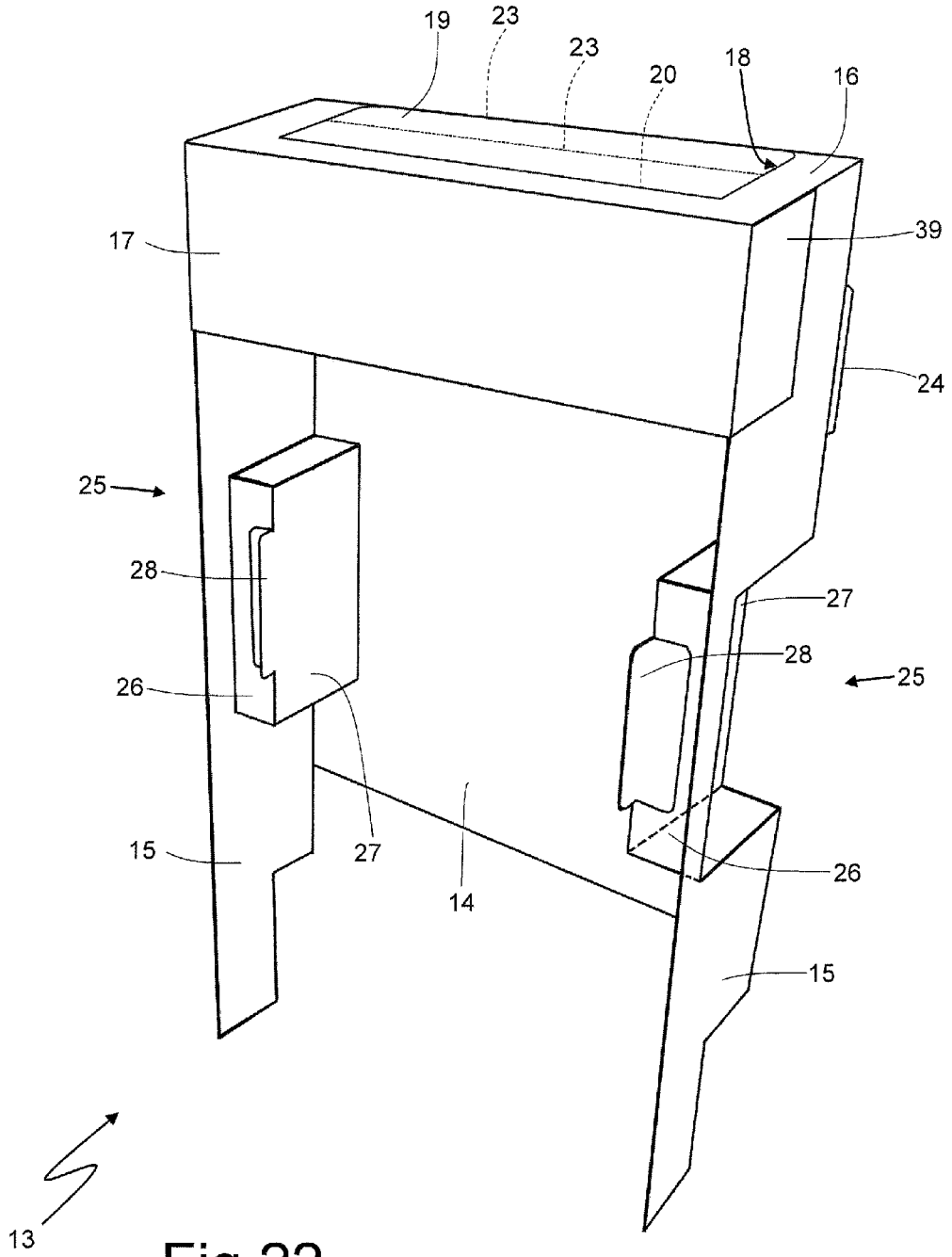
FIG. 22 is a rear perspective view and in a closed configuration of an alternative of the collar of FIG. 6.
Figure 23:
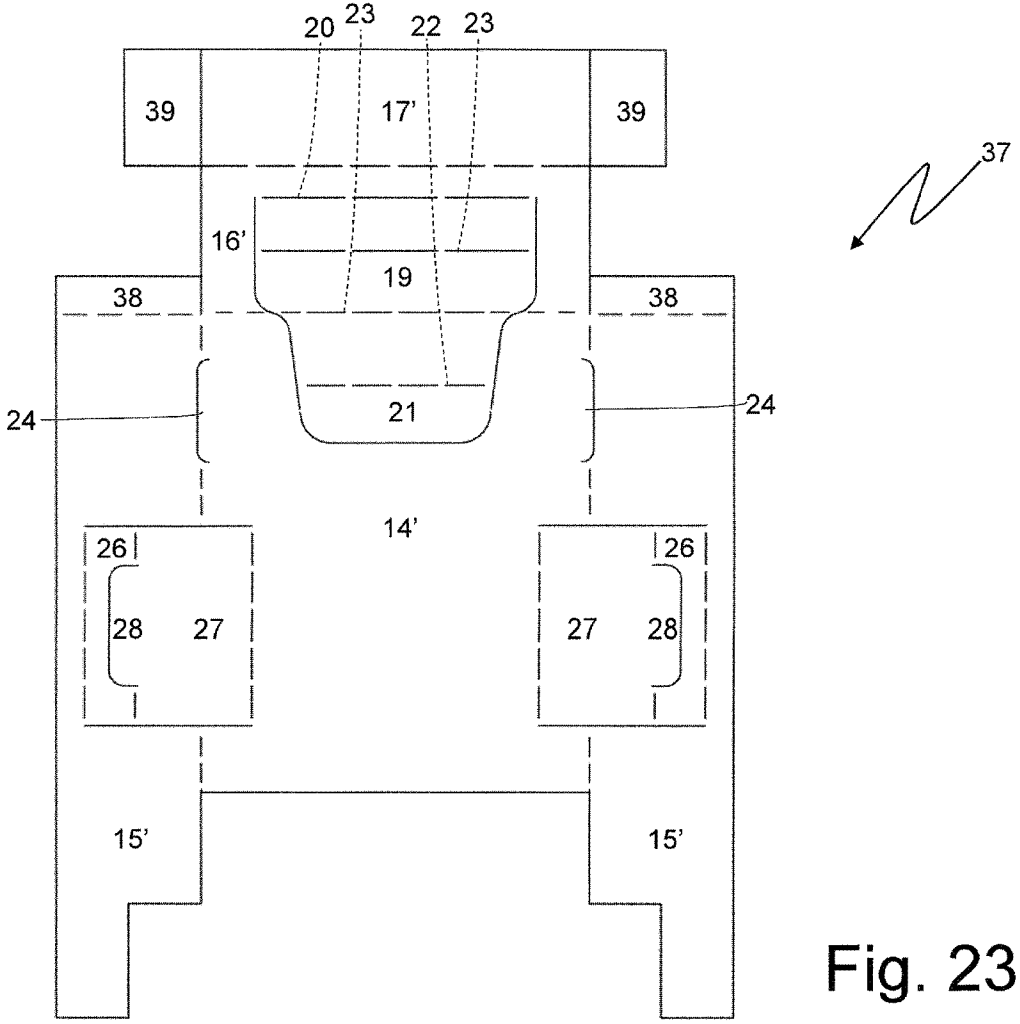
FIG. 23 is a plan view of a blank used to make the collar of FIG. 22.

According to the embodiment illustrated in FIG. 22, the rear wall 17 of the collar 13 has laterally a pair of connecting flaps 39, which are arranged at opposite sides of the rear wall 17, are folded by 90° relative to the rear wall 17, and are glued to the corresponding lateral walls 15 of collar 13. In FIG. 23 the blank 37 is illustrated which is similar to the blank 37 illustrated in FIG. 13 and is suited to form the collar 13 shown in FIG. 22 and provided with the connecting flaps 39. According to the embodiment shown in FIGS. 22 and 23, one same collar 13 has both the connecting flaps 38 (connected to the upper wall 16 or the lateral wall 15), and the connecting flaps 39 (connected to the rear wall 17). The connecting flaps 39 serve to stabilize the rear wall 17 of the collar 13, or to make the rear wall 17 of the collar 13 more stable in its position by avoiding that the rear wall of the collar 13 can conduct (small) unwanted movement particularly during the rotation of the lid 3. Due to the presence of the connecting flaps 39 it is avoided that the lid 3 can be jammed against the collar 13 when the lid 3 is closed again after a complete opening by 180°. Moreover, thanks to the presence of the connecting flaps 39 retention of the lid 3 in the closed position is improved.

Figure 26:
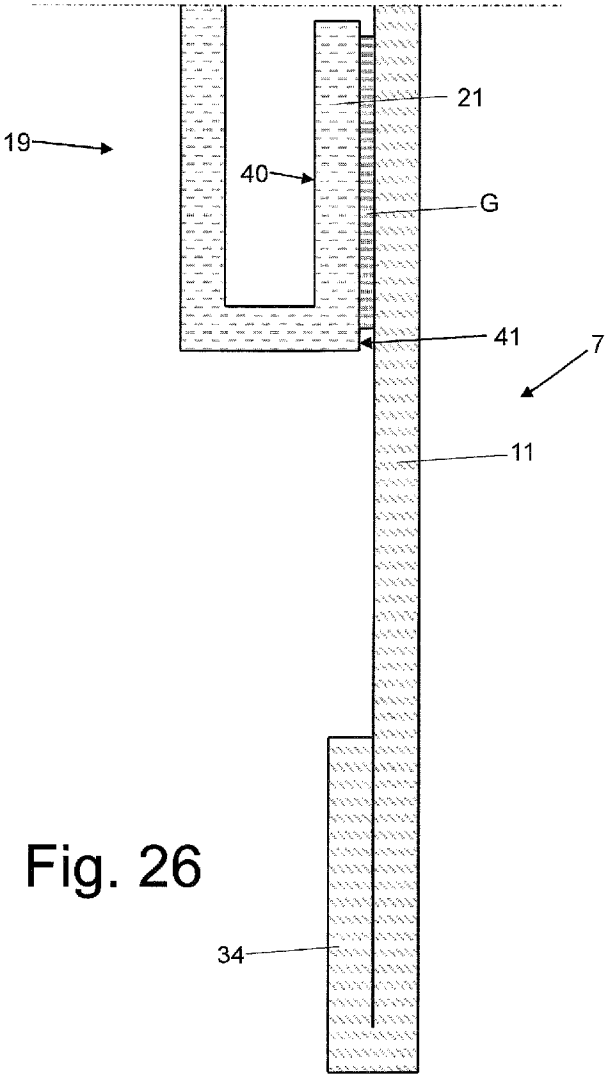
FIG. 26 is a schematic view of a portion of a mobile portion of a collar glued to an inner face of a front wall of a lid of the pack of cigarettes of FIG. 25.
Figure 24:
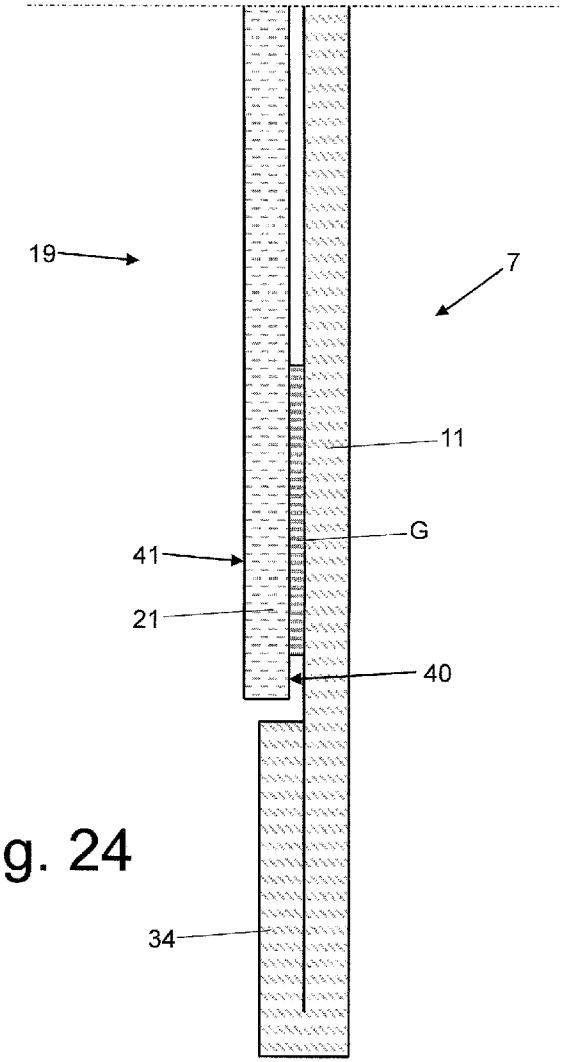
FIG. 24 is a schematic view of a portion of a mobile portion of a collar glued to an inner face of a front wall of a lid of the pack of cigarettes in FIG. 1.
Figure 25:
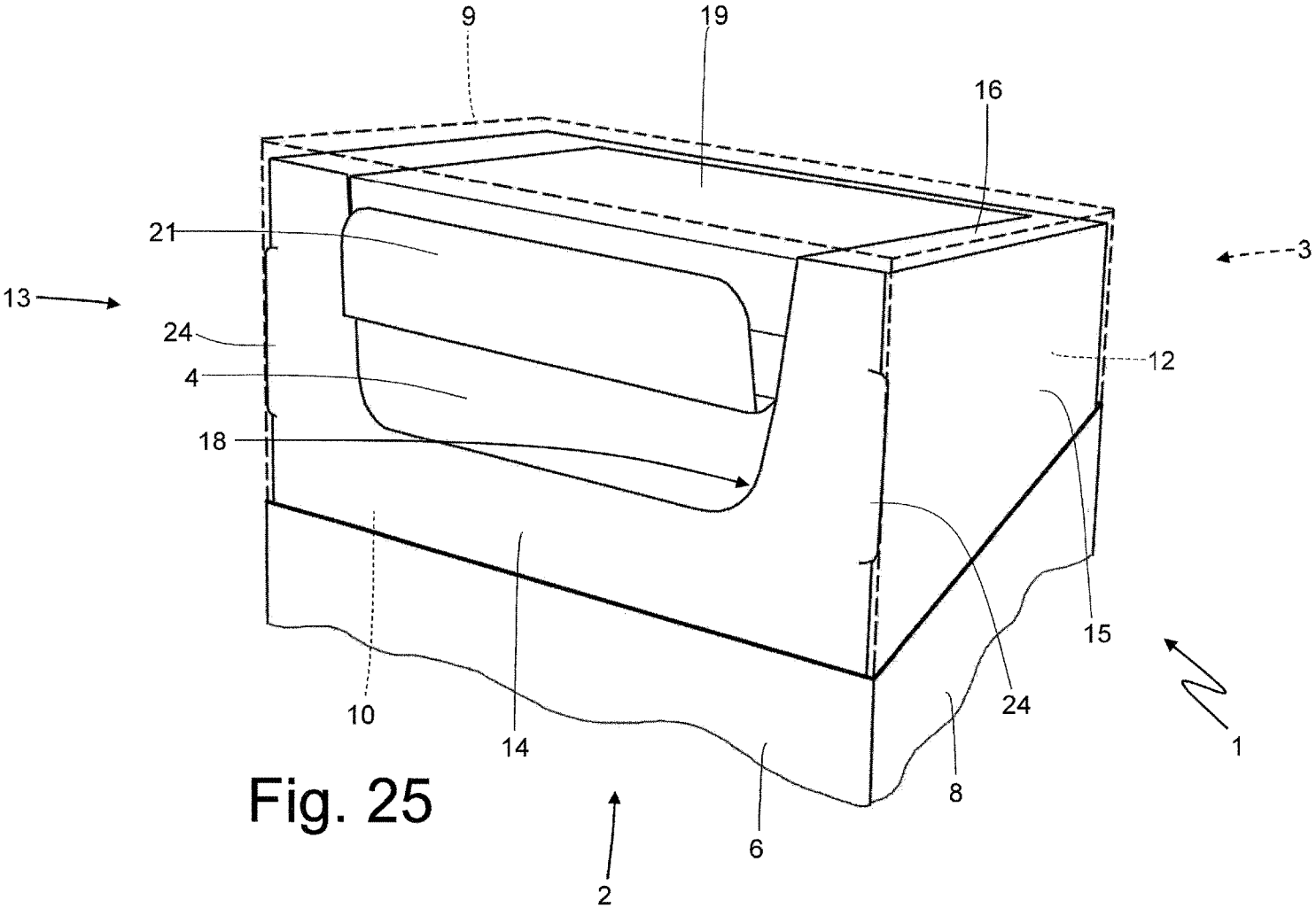
FIG. 25 is a front perspective view and in a closed configuration of an upper part of a different embodiment of the pack of cigarettes in FIG. 1.

In the embodiments illustrated in FIGS. 1-24 and as clearly shown in FIG. 24, the outer surface 40 of the lower element 21 of the mobile portion 19 of the collar 13 is glued by permanent glue G to the inner face of the front wall 10 of the lid 3, so when the lid 3 is arranged in the closed position (illustrated in FIG. 24), the mobile portion 19 of the collar 13 has a flat conformation at the lower element 21. In the alternative embodiment illustrated in FIGS. 25-34 and as clearly illustrated in FIG. 26, the inner surface 41 of the lower element 21 of the mobile portion 19 of the collar 13 is glued to the inner face of the front wall 10 of the lid 3, so that when the lid 3 is arranged in the closed position (illustrated in FIG. 26), the mobile portion 19 has a "U" shape at the bottom of the element 21; in other words, when the lid 3 is arranged in the closed position (illustrated in FIG. 26), the mobile portion 19 of the collar 13 is folded into a "U" in correspondence to the underlying element 21 allowing to be glued by means of the permanent glue G the inner surface 41 of the lower element 21 of the mobile portion 19 to the inner face of the front wall 10 of the lid 3. Then, when the lid 3 is arranged in the closed position (illustrated in FIG. 26), at the lower element 21 the mobile portion 19 of the collar 13 forms a backwards turned concave portion.

Figure 27:
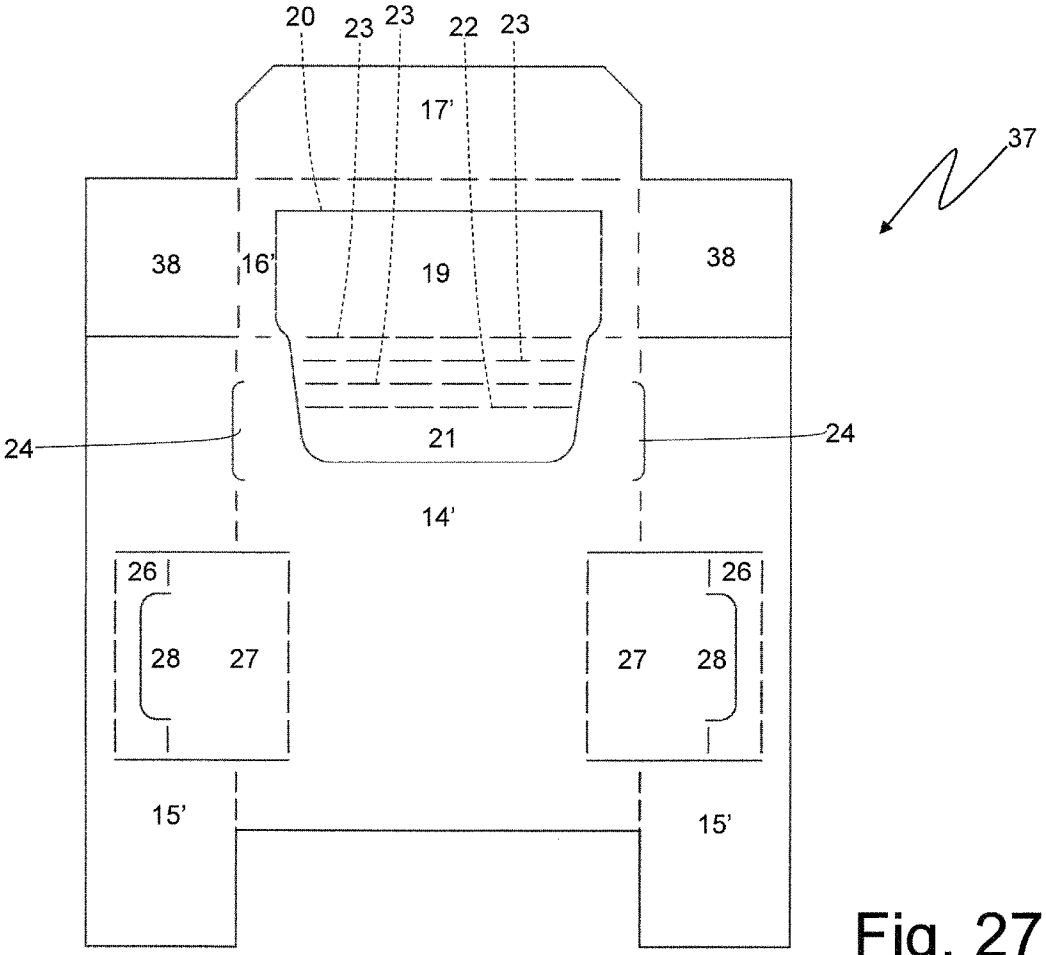
FIG. 27 is a plan view of a blank used to make a collar of the pack of cigarettes of FIG. 25.
Figure 28:
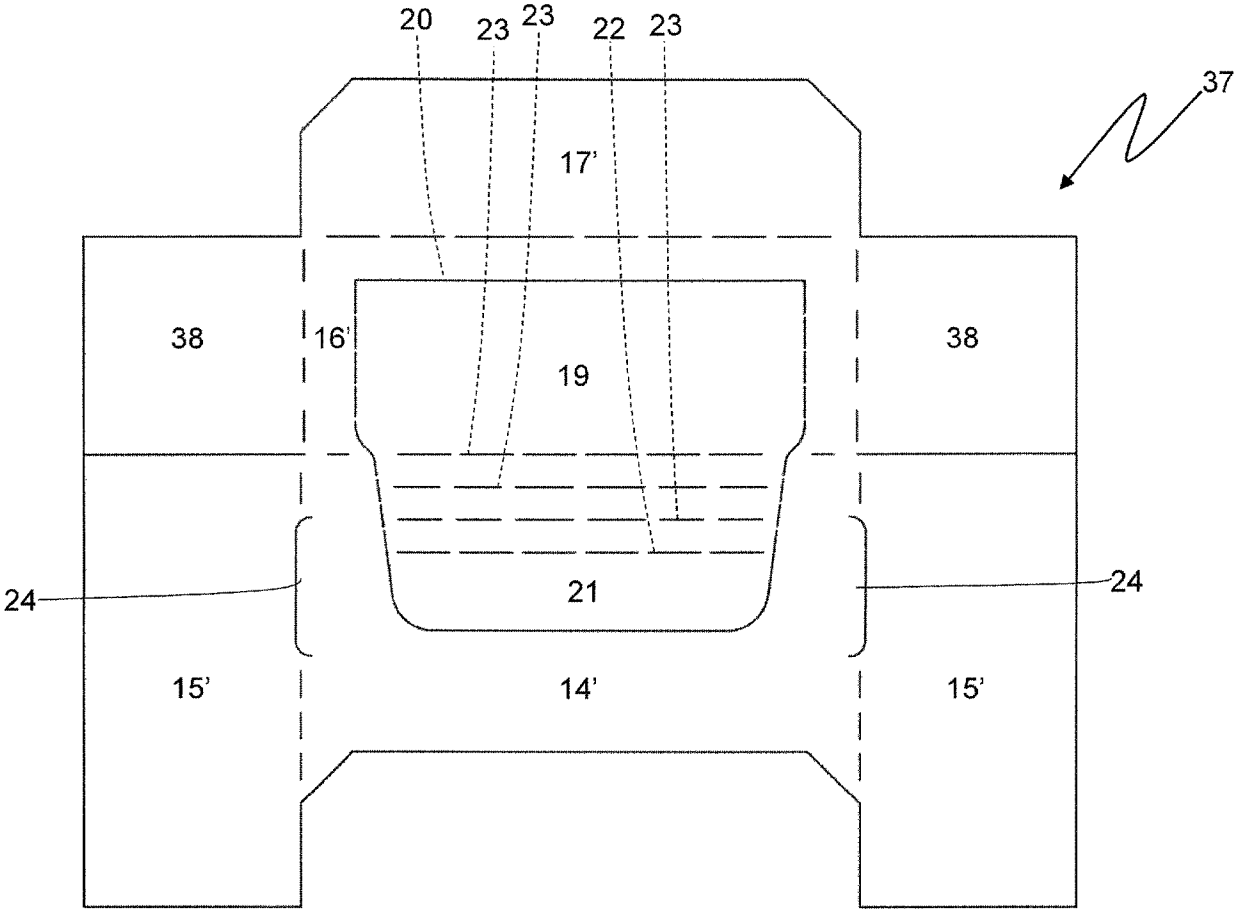
FIG. 28 is a plan view of an alternative of the blank of FIG. 27.
Figure 29:
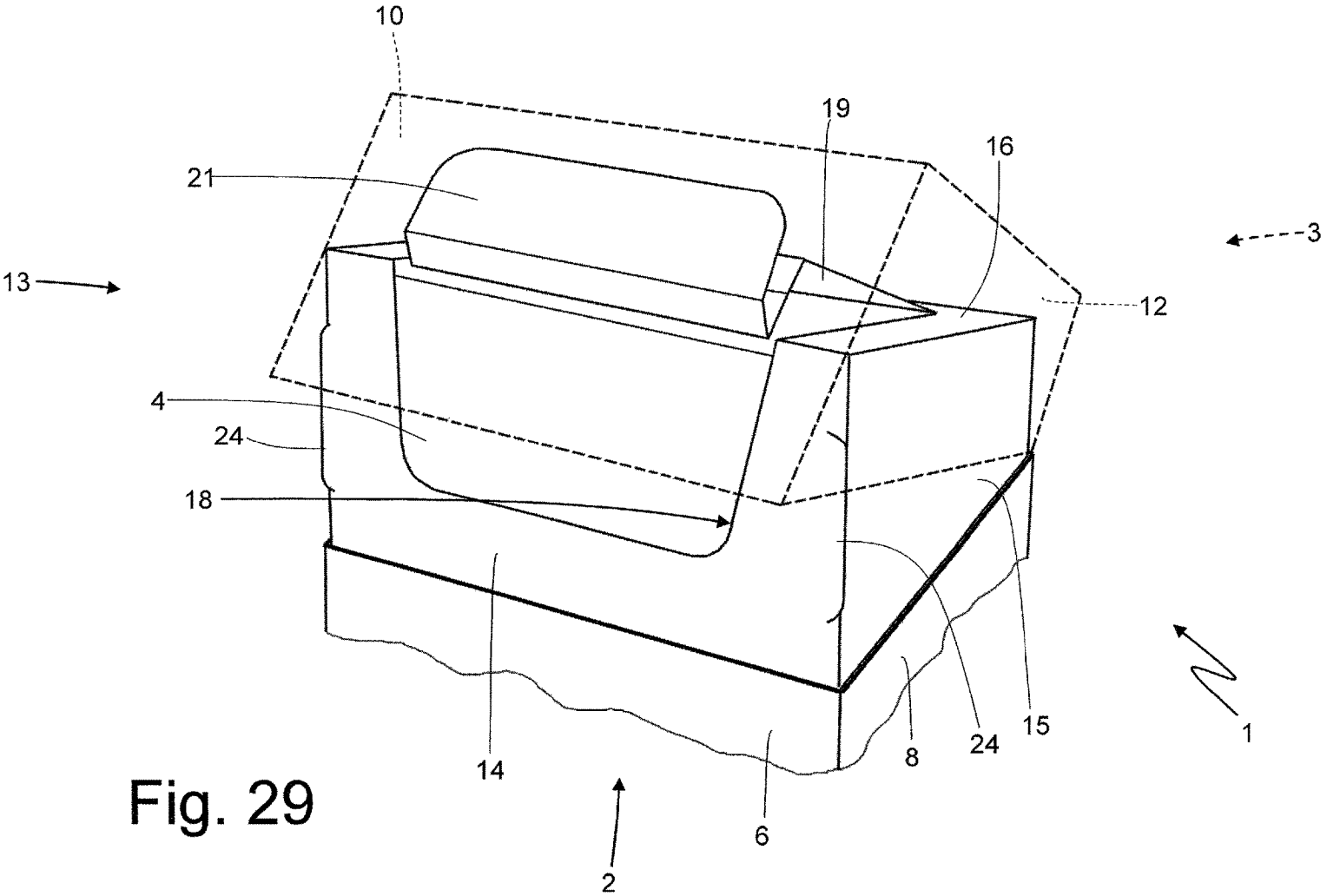
FIGS. 29-34 are a sequence of perspective views of a front and upper part of the pack of cigarettes of FIG. 24 during the opening and the subsequent closing of the lid.
Figure 30:
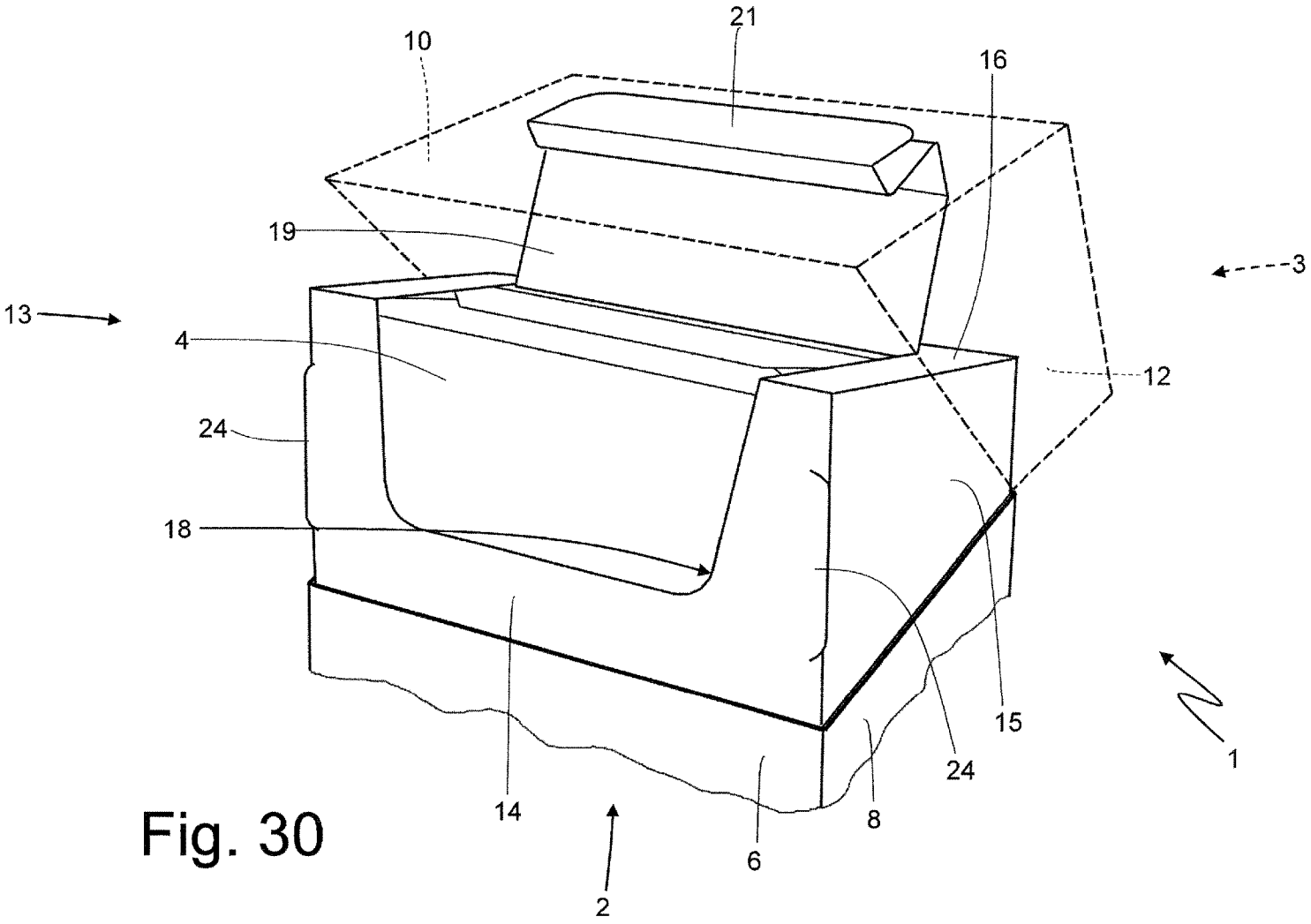
Figure 31:
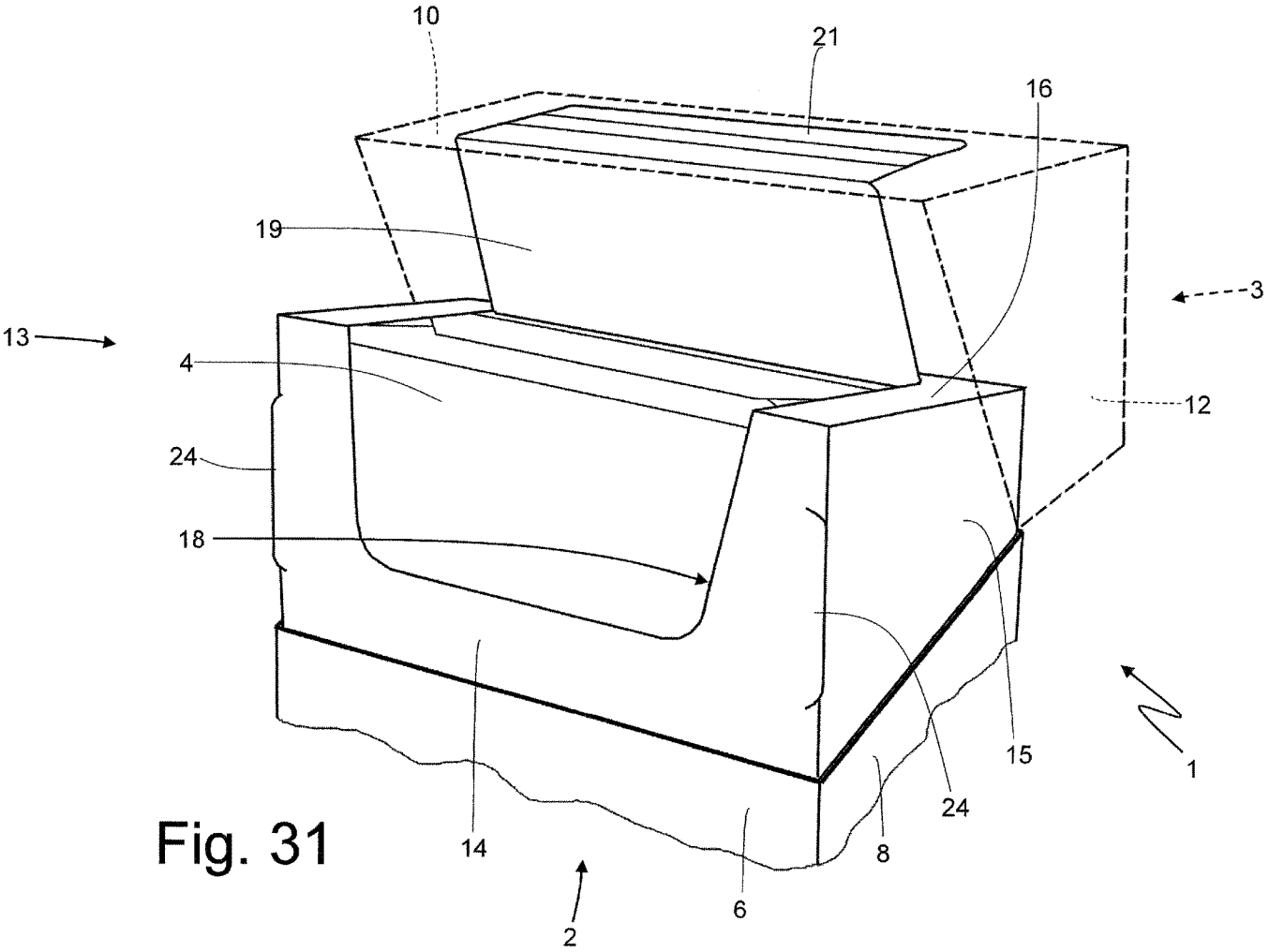
Figure 32:
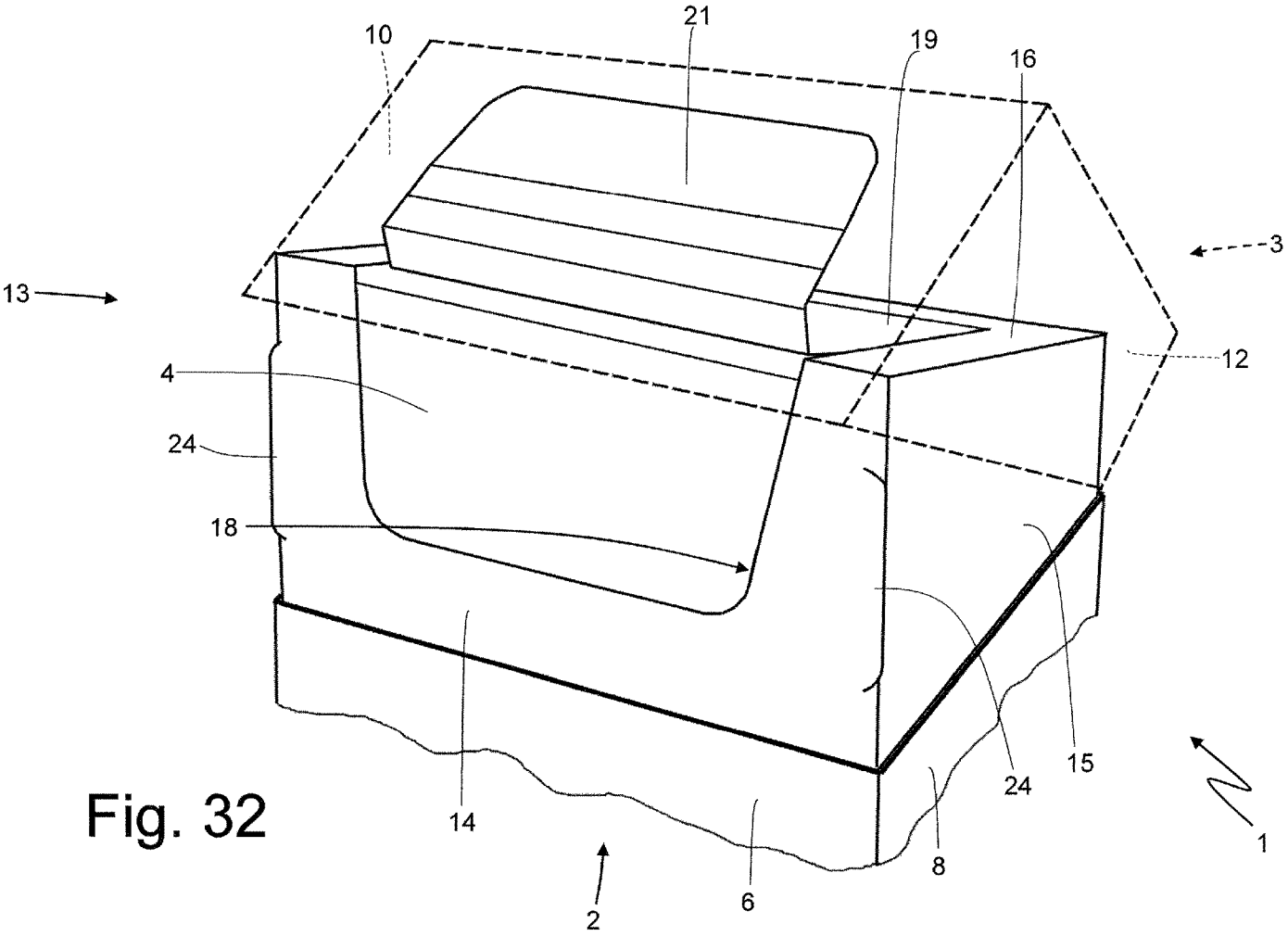
Figure 33:
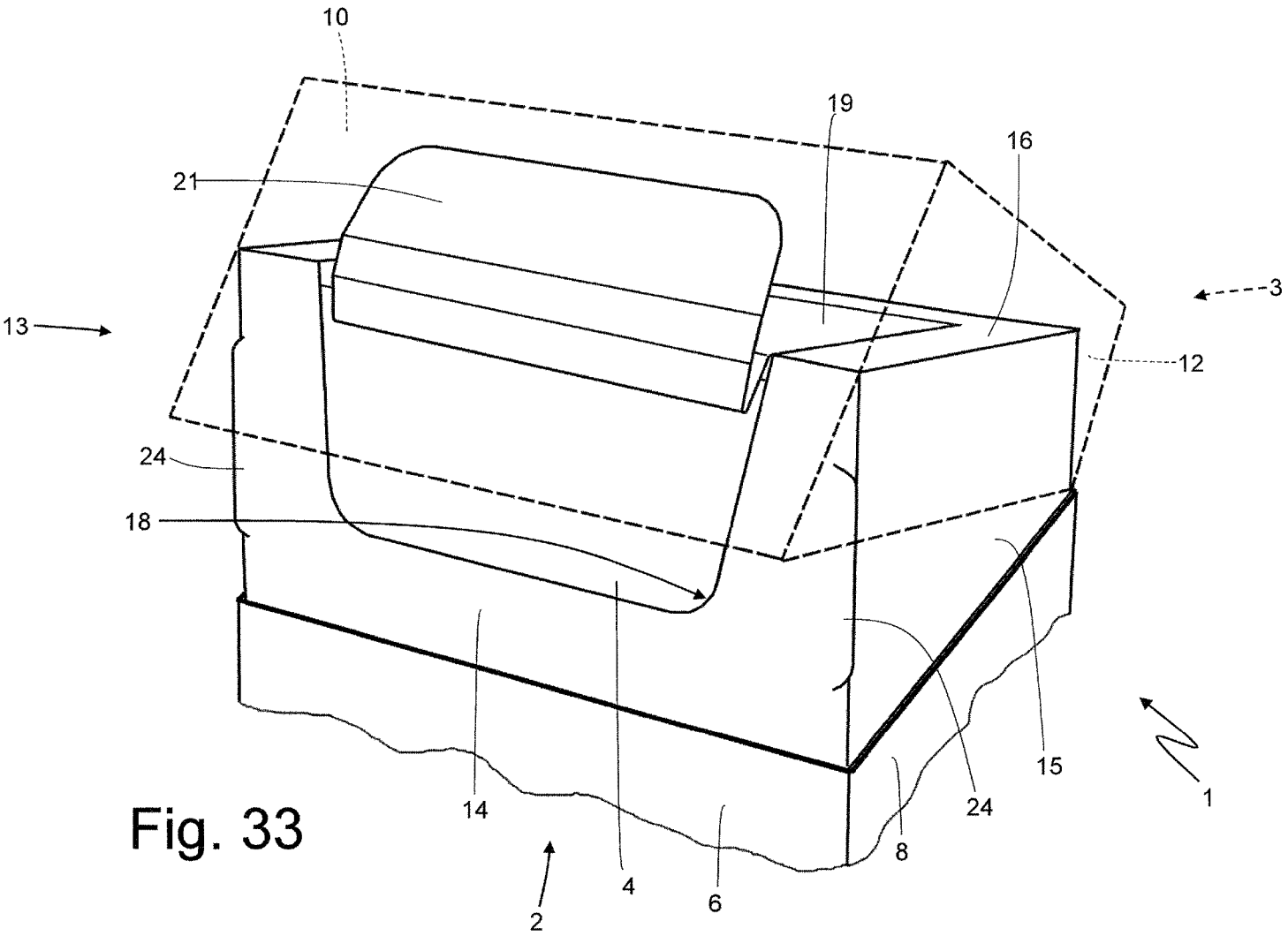
Figure 34:
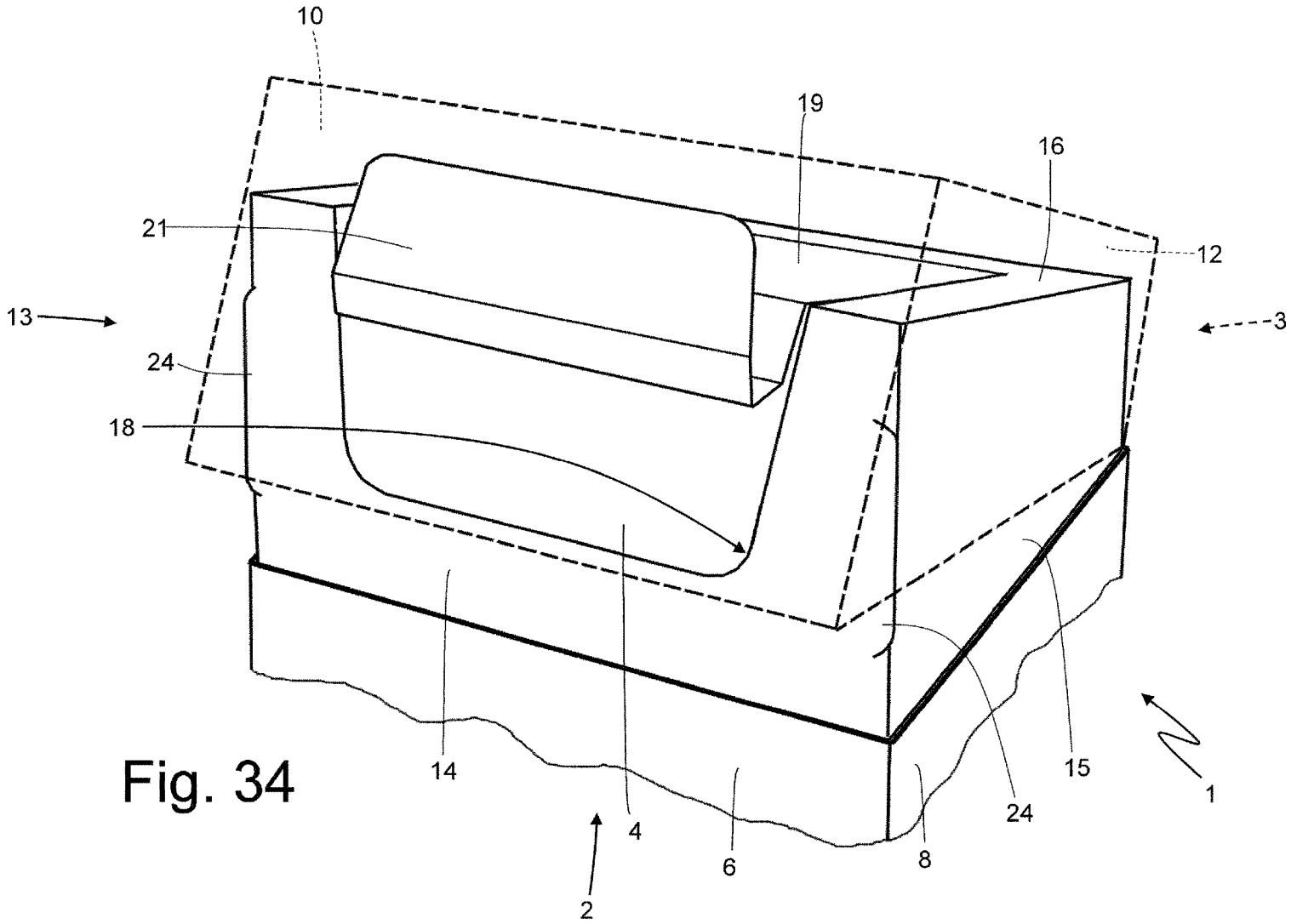

As illustrated in FIGS. 27 and 28, the lower element 21 of the mobile portion 19 of the collar 13 is separated from the remaining part of the mobile portion 19 by a pre-weakened folding line 22 that allows locally a smooth folding of the mobile portion 19 itself. To obtain a correct movement of the mobile portion 19 of the collar 13 (or to prevent jamming) it is preferable that the mobile portion 19 is provided with at least three additional pre-weakened folding line 23 that are arranged at a certain distance from each other and from the pre-weakened folding line 22; a first pre-weakened folding line 23 is initially arranged astride between the front wall 14 and the upper wall 16 of the collar 13, while the other two pre-weakened folding lines 23 are arranged between the first pre-weakened folding line 23 and the pre-weakened folding lines 22 (and are preferably equally spaced).

In FIGS. 29-34 the opening movement of the lid 3 which determines a deformation of the mobile portion 19 of the collar 13 is schematically illustrated.

The embodiment illustrated in FIGS. 25-34 allows to lock the lid 3 in the open position, as the upper wall of the mobile portion 19 of the collar 13 hits against the lid 3 when the lid 3 is opened and so it is necessary to apply a certain force to elastically deform the upper wall of the mobile portion 19, and then allow the re-closure of the lid 3. In other words, in the embodiment illustrated in FIGS. 25-34 the mobile portion 19 acts as a locking device which keeps the lid 3 in the open position and requires the application of a certain closing force to unlock the rotation of the lid 3 and allow therefore the reclosing of the lid 3 itself. This characteristic is particularly appreciated by some users, as keeping the lid open 3 simplifies the extraction of cigarettes (i.e. the user can focus on the extraction of cigarettes at the same time without having to use the fingers to keep the lid 3 open).

In the embodiments illustrated, the inner wrap 4 is arranged symmetrical (or centred) with respect to the lateral walls 8 of container 2, and then the lateral walls of the inner wrap 4 are equidistant from the corresponding lateral walls 8 of container 2. According to a different and perfectly equivalent embodiment not illustrated, the inner wrap 4 is arranged asymmetrically (i.e. not centred) with respect to the lateral walls 8 of container 2, and then the lateral walls of the inner wrap 4 are not equidistant from the corresponding lateral walls 8 of container 2; in this embodiment a support element 25 is wider than the other support element 25 or there is a single support element 25 (therefore from the opposite side the inner wrap 4 is arranged in contact with the corresponding lateral wall 8 of the container 2).

The pack 1 of cigarettes described above has numerous advantages.

In the first place, the pack 1 of cigarettes described above ensures in all conditions a suitable locking of the inner wrap (i.e. is always able to prevent effectively the inner wrap 4 from "shaking" inside the container 2); said result is obtained thanks to the fact that the collar 13 has the upper wall 16 and the rear wall 17 which give the collar 13 a greater stiffness and therefore allow a better containment of the inner wrap 4. At the same time, the presence of the pull-out opening allows to extract the cigarettes contained inside the inner wrap 4 as well in the presence of the upper wall 16.

The pack 1 of cigarettes described above uses a relatively small quantity of wrapping material (or only slightly greater than the amount of wrapping material used in a rigid pack with a standard type hinged lid).

The pack 1 of cigarettes described above has also a great aesthetic impact at the opening of the lid 3, since the upper wall 16 of the collar 13 by closing the upper spaces not occupied by the inner wrap 4 (otherwise in sight) provide the consumer a particularly appreciated feeling of "completeness" and "solidity". The upper wall 16 of the collar 13 can also be printed with trademarks, drawings or writing (due to its highly visible position, the upper wall 16 of the collar 13 allows to better enhance the printing on the upper wall 16 itself).

The pack 1 of cigarettes described above offers a better closure of the inner wrap 4 after the first opening of the pack 1 of cigarettes (i.e. after removing the removable tear-off upper portion of the inner wrap 4) thanks to the presence of the mobile part 19 of the collar 13.

The pack 1 of cigarettes described above can be manufactured in a fast and inexpensive way, as the blank 37 for the collar 13 has a relatively conventional shape (i.e. similar to the blanks known and normally used to make the collars of rigid pack of cigarettes with a hinged lid currently on the market); in this context, it is important to observe the blank used to make the container 2 and the lid 3 is entirely conventional (i.e. identical to the blanks known and normally used for making the rigid hinged-lid packs of cigarettes currently on the market).

Because of the many advantages presented by the pack 1 of cigarettes described above, the shape of such a pack 1 of cigarettes may be integrally reused also for the manufacturing of a pack of other types of tobacco articles (such as cigars, electronic cigarettes, charging cartridges for electronic cigarettes, pieces of tobacco for electronic cigarettes).

The invention claimed is:

1. A rigid pack (1) for tobacco articles comprising:

a container (2), which has a parallelepiped shape, has an open upper end, a container lower wall (5), a container front wall (6), a container rear wall (7), and two container lateral walls (8);

a lid (3) which is hinged to the container (2), has a parallelepiped shape and has a lid upper wall (9), a lid front wall (10), a lid rear wall (11), and two lid lateral walls (12);

an inner wrap (4) which encloses a group of tobacco articles, and is housed on the inside of the container (2); and a collar (13), which embraces the inner wrap (4), is internally glued to the container (2), and protrudes from the open upper end of the container (2) and has: a collar front wall (14), two collar lateral walls (15) and a collar upper wall (16) which is perpendicular to the collar front wall (14); and wherein the collar (13) has a pull-out opening (18) for the tobacco articles which involves a portion of the collar front wall (14) and a portion of the collar upper wall (16); and wherein the collar upper wall (16) comprises a fixed frame which is "U"-shaped and surrounds an upper part of the pull-out opening (18) on three different sides.

2. The pack (1) for tobacco articles according to claim 1 wherein the collar (13) comprises a collar rear wall (17) which is perpendicular to the collar upper wall (16), is parallel and opposite to the collar front wall (14), and overlaps the container rear wall (11).

3. The pack (1) for tobacco articles according to claim 2, wherein the collar rear wall (17) laterally has a pair of connecting flaps (39), which are arranged at opposite sides of the collar rear wall (17), are folded by 90° relative to the collar rear wall (17), and are glued to the corresponding collar lateral walls (15).

4. The pack (1) for tobacco articles according to claim 1, wherein the pull-out opening (18) for the collar (13) is defined by a through-incision which is made through the collar (13) and delimits internally a mobile portion (19) of the collar (13) that at least initially closes the pull-out opening (18).

5. The pack (1) for tobacco articles according to claim 4, wherein:

the through-incision defining the pull-out opening (18) has a "U" open shape; and the mobile portion (19) of the collar (13) always remains connected to the remaining part of the collar (13) and is connected to the remaining part of the collar (13) along a hinge line (20).

6. The pack (1) for tobacco articles according to claim 5, wherein the mobile portion (19) of the collar (13) is glued to the inner face of the lid front wall (10) to obtain the opening and the closing of the mobile portion (19) by exploiting the movement of the lid (3).

7. The pack (1) for tobacco articles according to claim 6, wherein a lower element (20) of the mobile portion (19) is glued to the inner face of the lid front wall (10), said lower element (20) being initially arranged at the collar front wall (14) and being separated from the remaining part of the mobile portion (19) by a first pre-weakened folding line (22).

8. The pack (1) for tobacco articles according to claim 6, wherein the mobile portion (19) is provided with a second pre-weakened folding line (23) which is initially arranged astride between the collar front wall (14) and the collar upper wall (16), and with a third pre-weakened folding line (23) which is initially arranged at the collar upper wall (16).

9. The pack (1) for tobacco articles according to claim 6, wherein the mobile portion (19) of the collar (13) is provided with a second pre-weakened folding line (23) which is initially arranged astride between the collar front wall (14) and the collar upper wall (16), and with two third pre-weakened folding lines (23) which are arranged between the first pre-weakened folding line (22) and the second pre-weakened folding line (23).

10. The pack (1) for tobacco articles according to claim 7, wherein an outer surface (40) of the lower element (21) of the mobile portion (19) of the collar (13) is glued to the inner face of the lid front wall (10) so that when the lid (3) is arranged in a closed position the mobile portion (19) has a flat configuration at a corresponding lower element (21).

11. The pack (1) for tobacco articles according to claim 7, wherein an inner surface (41) of the lower element (21) of the mobile portion (19) is glued to the inner face of the lid front wall (10) so that when the lid (3) is arranged in a closed position the mobile portion (19) of the collar (13) has a "U"-shaped configuration at a lower element (21).

12. The pack (1) for tobacco articles according to claim 4, wherein:

the through-incision defining the pull-out opening (18) has a closed shape; and the mobile portion (19) of the collar (13) is removable from the collar (13), thus leaving the pull-out opening (18) always open, the first time the pack (1) is opened or during the manufacturing of the pack (1) for tobacco articles.

13. The pack (1) for tobacco articles according to claim 12, wherein the mobile portion (19) is glued to an underlying removable tear-off upper portion of the inner wrap (4).

14. The pack (1) for tobacco articles according to claim 4, wherein the through-incision that defines the pull-out opening (18) initially is discontinuous, namely it initially has residual contact points that can be easily torn.

15. The pack (1) for tobacco articles according to claim 1, wherein the collar upper wall (16) comprises a pair of connecting flaps (38), each of which is hinged to the collar upper wall (16), is folded by 90° relative to the collar upper wall (16), and is glued to a corresponding collar lateral wall (15).

16. The pack (1) for tobacco articles according to claim 1, wherein each collar lateral wall (15) comprises a connecting flap (38), which is hinged to the collar lateral wall (15), is folded by 90° relative to the collar lateral wall (15), and is glued to the collar upper wall (16).

17. The pack (1) for tobacco articles according to claim 1, wherein:

the inner wrap (4) has a narrower cross section compared to the cross section of the container (2); and the collar (13) comprises at least one support element (25), which projects from a corresponding collar lateral wall (15) and rests against the inner wrap (4) to help keep the inner wrap (4) in the correct position.

18. The pack (1) for tobacco articles according to claim 17, wherein the support element (25) is, in its cross sectional view, "L"-shaped and comprises a first panel (26) which originates from a corresponding collar lateral wall (15) and is perpendicular to the collar lateral wall (15), and a second panel (27), which is joined to the first panel (26), originates from the collar front wall (14), is perpendicular to the front wall (14) and rests against a corresponding inner wrap lateral wall of the inner wrap (4).

19. The pack (1) for tobacco articles according to claim 18, wherein:

the second panel (27) has an appendage (28) that projects from the second panel (27), thus extending out of the plane defined by the corresponding first panel (26); and the appendage (28) is obtained by means of a through-incision, which is "U"-shaped and is made through the corresponding first panel (26).

20. The pack (1) for tobacco articles according to claim 1, wherein:

the inner wrap (4) has a less deep cross section compared to the cross section of the container (2); and a filler element (29) is provided, which is interposed between an inner wrap rear wall of the inner wrap (4) and the container rear wall (7), so as to compensate for the lesser thickness of the inner wrap (4) compared to the thickness of the container (2).

21. A rigid pack (1) for tobacco articles comprising:

a container (2), which has a parallelepiped shape, has an open upper end, a container lower wall (5), a container front wall (6), a container rear wall (7), and two container lateral walls (8);

a lid (3) which is hinged to the container (2), has a parallelepiped shape and has a lid upper wall (9), a lid front wall (10), a lid rear wall (11), and two lid lateral walls (12);

an inner wrap (4) which encloses a group of tobacco articles, and is housed on the inside of the container (2); and a collar (13), which embraces the inner wrap (4), is internally glued to the container (2), and protrudes from the open upper end of the container (2) and has: a collar front wall (14), two collar lateral walls (15) and a collar upper wall (16) which is perpendicular to the collar front wall (14); and wherein the collar (13) has a pull-out opening (18) for the tobacco articles which involves a portion of the collar front wall (14) and a portion of the collar upper wall (16);

wherein the collar (13) comprises a collar rear wall (17) which is perpendicular to the collar upper wall (16), is parallel and opposite to the collar front wall (14), and overlaps the container rear wall (11); and wherein the collar rear wall (17) laterally has a pair of connecting flaps (39), which are arranged at opposite sides of the collar rear wall (17), are folded by 90° relative to the collar rear wall (17), and are glued to the corresponding collar lateral walls (15).

22. A rigid pack (1) for tobacco articles comprising:

a container (2), which has a parallelepiped shape, has an open upper end, a container lower wall (5), a container front wall (6), a container rear wall (7), and two container lateral walls (8);

a lid (3) which is hinged to the container (2), has a parallelepiped shape and has a lid upper wall (9), a lid front wall (10), a lid rear wall (11), and two lid lateral walls (12);

an inner wrap (4) which encloses a group of tobacco articles, and is housed on the inside of the container (2); and a collar (13), which embraces the inner wrap (4), is internally glued to the container (2), and protrudes from the open upper end of the container (2) and has: a collar front wall (14), two collar lateral walls (15) and a collar upper wall (16) which is perpendicular to the collar front wall (14); and wherein the collar (13) has a pull-out opening (18) for the tobacco articles which involves a portion of the collar front wall (14) and a portion of the collar upper wall (16); and wherein the collar upper wall (16) comprises a pair of connecting flaps (38), each of which is hinged to the collar upper wall (16), is folded by 90° relative to the collar upper wall (16), and is glued to a corresponding collar lateral wall (15) of the collar (13).

23. A rigid pack (1) for tobacco articles comprising:

a container (2), which has a parallelepiped shape, has an open upper end, a container lower wall (5), a container front wall (6), a container rear wall (7), and two container lateral walls (8);

a lid (3) which is hinged to the container (2), has a parallelepiped shape and has a lid upper wall (9), a lid front wall (10), a lid rear wall (11), and two lid lateral walls (12);

an inner wrap (4) which encloses a group of tobacco articles, and is housed on the inside of the container (2); and a collar (13), which embraces the inner wrap (4), is internally glued to the container (2), and protrudes from the open upper end of the container (2) and has: a collar front wall (14), two collar lateral walls (15) and a collar upper wall (16) which is perpendicular to the collar front wall (14); and wherein the collar (13) has a pull-out opening (18) for the tobacco articles which involves a portion of the collar front wall (14) and a portion of the collar upper wall (16); and wherein each collar lateral wall (15) comprises a connecting flap (38), which is hinged to the collar lateral wall (15), is folded by 90° relative to the collar lateral wall (15), and is glued to the collar upper wall (16).

24. A rigid pack (1) for tobacco articles comprising:

a container (2), which has a parallelepiped shape, has an open upper end, a container lower wall (5), a container front wall (6), a container rear wall (7), and two container lateral walls (8);

a lid (3) which is hinged to the container (2), has a parallelepiped shape and has a lid upper wall (9), a lid front wall (10), a lid rear wall (11), and two lid lateral walls (12);

an inner wrap (4) which encloses a group of tobacco articles, and is housed on the inside of the container (2); and a collar (13), which embraces the inner wrap (4), is internally glued to the container (2), and protrudes from the open upper end of the container (2) and has: a collar front wall (14), two collar lateral walls (15) and a collar upper wall (16) which is perpendicular to the collar front wall (14); and wherein the collar (13) has a pull-out opening (18) for the tobacco articles which involves a portion of the collar front wall (14) and a portion of the collar upper wall (16);

wherein the inner wrap (4) has a narrower cross section compared to the cross section of the container (2);

wherein the collar (13) comprises at least one support element (25), which projects from a corresponding collar lateral wall (15) and rests against the inner wrap (4) to help keep the inner wrap (4) in the correct position wherein the support element (25) is, in its cross sectional view, "L"-shaped and comprises a first panel (26) which originates from a corresponding collar lateral wall (15) and is perpendicular to the collar lateral wall (15), and a second panel (27), which is joined to the first panel (26), originates from the collar front wall (14), is perpendicular to the front wall (14) and rests against a corresponding inner wrap lateral wall of the inner wrap (4);

wherein the second panel (27) has an appendage (28) that projects from the second panel (27), thus extending out of the plane defined by the corresponding first panel (26); and wherein the appendage (28) is obtained by means of a through-incision, which is "U"-shaped and is made through the corresponding first panel (26).

* * * * *